US006212347B1

(12) United States Patent
Zhao et al.

(10) Patent No.: US 6,212,347 B1
(45) Date of Patent: Apr. 3, 2001

(54) IMAGING APPARATUSES AND PROCESSES THEREOF CONTAINING A MARKING MATERIAL WITH A CHARGE ACCEPTANCE ADDITIVE OF AN ALUMINUM COMPLEX

(75) Inventors: Weizhong Zhao, Webster; David H. Pan, Rochester; John W. Spiewak, Webster; Christopher M. Knapp, Fairport, all of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/492,429

(22) Filed: Jan. 27, 2000

(51) Int. Cl.[7] ..... G03G 15/10; G03G 15/16
(52) U.S. Cl. ..... 399/237; 399/296
(58) Field of Search ..... 399/237, 238, 399/239, 240, 296; 430/114, 115, 117

(56) References Cited

U.S. PATENT DOCUMENTS 4,536,457 8/1985 Tam ..... 430/41
4,536,458 8/1985 Ng ..... 430/41

(List continued on next page.)

*Primary Examiner*—Arthur T. Grimley
*Assistant Examiner*—Hoang Ngo
(74) *Attorney, Agent, or Firm*—E. O. Palazzo

(57) ABSTRACT

An imaging apparatus containing an imaging member with an electrostatic latent image formed thereon, the imaging member containing a surface capable of supporting marking material;

an imaging device for generating the electrostatic latent image on the imaging member wherein the electrostatic latent image includes image areas defined by a first charge voltage and nonimage areas defined by a second charge voltage distinguishable from the first charge voltage;

a marking material supply apparatus for depositing marking material on the surface of the imaging member to form a marking material layer thereon adjacent the electrostatic latent image on the imaging member;

a charging source for selectively delivering charges to the marking material layer in an imagewise manner responsive to the electrostatic latent image on the imaging member to form a secondary latent image in the marking material layer containing image and nonimage areas corresponding to the electrostatic latent image on the imaging member; and a separator member for selectively separating portions of the marking material layer in accordance with the secondary latent image in the marking material layer to create a developed image corresponding to the electrostatic latent image formed on the imaging member, and wherein the marking material is comprised of developer containing an optional liquid, resin, colorant, and a charge acceptance additive of an aluminum complex of the formulas, or mixtures thereof or wherein $R_1$ is selected from the group consisting of hydrogen and alkyl, and n represents the number of $R_1$ groups, and wherein the charge acceptance additive captures and retains negative ions or positive ions.

62 Claims, 2 Drawing Sheets

U.S. PATENT DOCUMENTS

| | | | |
|---|---|---|---|
| 4,707,429 | 11/1987 | Trout | 430/115 |
| 5,019,477 | 5/1991 | Felder | 430/115 |
| 5,030,535 | 7/1991 | Drappel et al. | 430/116 |
| 5,045,425 | 9/1991 | Swidler | 430/115 |
| 5,223,368 | 6/1993 | Ciccarelli et al. | 430/110 |
| 5,306,591 | 4/1994 | Larson et al. | 430/115 |
| 5,324,613 | 6/1994 | Ciccarelli et al. | 430/110 |
| 5,346,795 | 9/1994 | Pickering et al. | 430/110 |
| 5,352,563 | 10/1994 | Kawasaki et al. | 430/264 |
| 5,366,840 | 11/1994 | Larson et al. | 430/115 |
| 5,409,803 | 4/1995 | Santos et al. | 430/331 |
| 5,441,841 | 8/1995 | Larson et al. | 430/115 |
| 5,563,015 | 10/1996 | Bonsignore et al. | 430/106 |
| 5,627,002 | 5/1997 | Pan et al. | 430/115 |
| 5,672,456 | 9/1997 | Chamberlain et al. | 430/115 |
| 5,679,492 * | 10/1997 | Chamberlain et al. | 430/115 |
| 5,826,147 | 10/1998 | Liu et al. | 399/237 |

* cited by examiner

IMAGING APPARATUSES AND PROCESSES THEREOF CONTAINING A MARKING MATERIAL WITH A CHARGE ACCEPTANCE ADDITIVE OF AN ALUMINUM COMPLEX

COPENDING APPLICATIONS AND PATENTS

Illustrated in copending applications U.S. Ser. Nos. 09/492,706, 09/492,715, and 09/492,707, all filed concurrently herewith, the disclosures of each application being totally incorporated herein by reference, are developers with charge acceptance component, imaging processes, and imaging apparatus thereof.

Illustrated in U.S. Pat. No. 5,627,002, the disclosure of which is totally incorporated herein by reference, is a positively charged liquid developer comprised of a nonpolar liquid, thermoplastic resin particles, pigment, a charge director, and a charge control agent comprised of a cyclodextrin or a cyclodextrin derivative containing one or more organic basic amino groups. A number of the appropriate components of this patent, especially the cyclodextrins may be selected for the invention of the present application in embodiments thereof and wherein with the present invention the cyclodextrins, especially beta-cyclodextrin function as a charge, either positive, or negative, acceptance component, agent, or additive.

In U.S. Pat. Nos. 5,366,840; 5,346,795 and 5,223,368, the disclosures of which are totally incorporated herein by reference, there are illustrated developer compositions with aluminum complex components and which components may be selected as a charge acceptance additive for the developers of the present invention.

Disclosed in U.S. Pat. No. 5,826,147, the disclosure of which is totally incorporated herein by reference, is an electrostatic latent image development process and an apparatus thereof wherein there is selected an imaging member with an imaging surface containing a layer of marking material and wherein imagewise charging can be accomplished with a wide beam ion source such that free mobile ions are introduced in the vicinity of an electrostatic image associated with the imaging member.

The appropriate components and processes of the above copending applications and patents may be selected for the present invention in embodiments thereof.

BACKGROUND OF THE INVENTION

This invention is generally directed to liquid developer compositions and processes thereof and wherein there can be generated excellent developed images thereof in, for example, bipolar ion charging processes, and reverse charge imaging and printing development (RCP) processes, wherein a first charging device generates a positive or negative toner polarity, and a second charging device generates an opposite toner charge of a negative or positive polarity, reference U.S. Pat. No. 5,826,147, the disclosure of which is totally incorporated herein by reference, and wherein the developer contains no charge director, or wherein the developer contains substantially no charge director. Preferably the liquid developer of the present invention is clear in color and is comprised of a resin, a hydrocarbon carrier, and as a charge acceptor a polyethylene oxide-polypropylene oxide, Alohas, an aluminum-di-tertiary butyl salicylate, as illustrated in U.S. Pat. No. 5,563,015, the disclosure of which is totally incorporated herein by reference, including a mixture of Alohas and EMPHOS PS-900™, a cyclodextrin charge acceptance agent, or charge acceptance additive component, and an optional colorant.

The present invention is also specifically directed to a electrostatographic imaging process wherein an electrostatic latent image bearing member containing a layer of marking material, toner particles, or liquid developer as illustrated herein and containing a charge acceptance additive, which additive may be coated on the developer, is selectively charged in an imagewise manner to create a secondary latent image corresponding to the first electrostatic latent image on the imaging member. Imagewise charging can be accomplished by a wide beam charge source which generates free mobile charges or ions in the vicinity of the electrostatic latent image coated with the layer of marking material or toner particles. The latent image causes the free mobile charges or ions to flow in an imagewise ion stream corresponding to the latent image. These charges or ions, in turn, are accepted by the marking material or toner particles, leading to imagewise charging of the marking material or toner particles with the layer of marking material or toner particles itself becoming the latent image carrier. The latent image carrying toner layer is subsequently developed by selectively separating and transferring image areas of the toner layer to substrates like paper thereby enabling an output document.

The present invention also relates to an imaging process and imaging apparatus, wherein an electrostatic latent image including image and nonimage areas are formed in a layer of marking material, and further wherein the latent image can be developed by selectively separating portions of the latent image bearing layer of the marking material comprised of a liquid developer such that the image areas reside on a first surface and the nonimage areas reside on a second surface. In an embodiment, the present invention relates to an image development apparatus, comprising a system for generating a first electrostatic latent image on an imaging member, wherein the electrostatic latent image includes image and nonimage areas having distinguishable charge potentials, and a system or device for generating a second electrostatic latent image on a layer of marking materials situated adjacent the first electrostatic latent image on the imaging member, wherein the second electrostatic latent image includes image and nonimage areas having distinguishable charge potentials of a polarity opposite to the charge potentials of the charged image and nonimage areas in the first electrostatic latent image. The apparatus and process details can in embodiments be as illustrated in U.S. Pat. No. 5,826,147, the disclosure of which is totally incorporated herein by reference.

The liquid developers and processes of the present invention possess in embodiments thereof a number of advantages including the development and generation of images with improved image quality, the avoidance of a charge director, the use of the developers in a reverse charging development process, excellent image transfer, and the avoidance of complex chemical charging of the developer. Poor transfer can, for example, result in poor solid area coverage if insufficient toner is transferred to the final substrate and can also cause image defects such as smears and hollowed fine features. Conversely, over-charging the toner particles may result in low reflective optical density images or poor color richness or chroma since only a few very highly charged particles can discharge all the charge on the dielectric receptor causing too little toner to be deposited. To overcome or minimize such problems, the liquid toners, or developers and processes of the present invention were arrived at after extensive research. Other advantages are as illustrated herein and also include minimal or no image blooming, the generation of excellent solid area images, minimal or no developed image character defects, and the like.

PRIOR ART

A latent electrostatic image can be developed with toner particles dispersed in an insulating nonpolar liquid. These dispersed materials are known as liquid toners, toner or liquid developers. The latent electrostatic image may be generated by providing a photoconductive imaging member (PC) or layer with a uniform electrostatic charge, and developing the image with a liquid developer, or colored toner particles dispersed in a nonpolar liquid which generally has a high volume resistivity in excess of about $10^9$ ohm-centimeters, a low dielectric constant, for example below about 3, and a moderate vapor pressure. Generally, the toner particles of the liquid developer are less than about or equal to about 30 $\mu$m (microns) average by area size as measured with the Malvern 3600E particle sizer.

U.S. Pat. No. 5,019,477, the disclosure of which is totally incorporated herein by reference, discloses a liquid electrostatic developer comprising a nonpolar liquid, thermoplastic resin particles, and a charge director. The ionic or zwitterionic charge directors illustrated may include both negative charge directors, such as lecithin, oil-soluble petroleum sulfonates and alkyl succinimide, and positive charge directors such as cobalt and iron naphthanates. The thermoplastic resin particles can comprise a mixture of (1) a polyethylene homopolymer or a copolymer of (i) polyethylene and (ii) acrylic acid, methacrylic acid or alkyl esters thereof, wherein (ii) comprises 0.1 to 20 weight percent of the copolymer; and (2) a random copolymer (iii) of vinyl toluene and styrene and (iv) butadiene and acrylate.

U.S. Pat. No. 5,030,535, the disclosure of which is totally incorporated herein by reference, discloses a liquid developer composition comprising a liquid vehicle, a charge additive and toner pigmented particles. The toner particles may contain pigment particles and a resin selected from the group consisting of polyolefins, halogenated polyolefins and mixtures thereof. The liquid developers can be prepared by first dissolving the polymer resin in a liquid vehicle by heating at temperatures of from about 80° C. to about 120° C., adding pigment to the hot polymer solution and attriting the mixture, and then cooling the mixture whereby the polymer becomes insoluble in the liquid vehicle, thus forming an insoluble resin layer around the pigment particles.

Moreover, in U.S. Pat. No. 4,707,429, the disclosure of which is totally incorporated herein by reference, there are illustrated, for example, liquid developers with an aluminum stearate charge adjuvant. Liquid developers with charge directors are also illustrated in U.S. Pat. No. 5,045,425. Also, stain elimination in consecutive colored liquid toners is illustrated in U.S. Pat. No. 5,069,995. Further, of interest with respect to liquid developers are U.S. Pat. Nos. 5,034,299; 5,066,821 and 5,028,508, the disclosures of which are totally incorporated herein by reference.

Lithographic toners with cyclodextrins as antiprecipitants, and silver halide developers with cyclodextrins are known, reference U.S. Pat. Nos. 5,409,803, and 5,352,563, the disclosures of which are totally incorporated herein by reference.

Illustrated in U.S. Pat. No. 5,306,591, the disclosure of which is totally incorporated herein by reference, is a liquid developer comprised of a liquid component, thermoplastic resin, an ionic or zwitterionic charge director, or directors soluble in a nonpolar liquid, and a charge additive, or charge adjuvant comprised of an imine bisquinone; in U.S. Statutory Invention Registration No. H1483 there is described a liquid developer comprised of thermoplastic resin particles, and a charge director comprised of an ammonium AB diblock copolymer, and in U.S. Pat. No. 5,307,731 there is disclosed a liquid developer comprised of a liquid, thermoplastic resin particles, a nonpolar liquid soluble charge director, and a charge adjuvant comprised of a metal hydroxycarboxylic acid, the disclosures of each of these patents, and the Statutory Registration being totally incorporated herein by reference.

SUMMARY OF THE INVENTION

Figure 1:
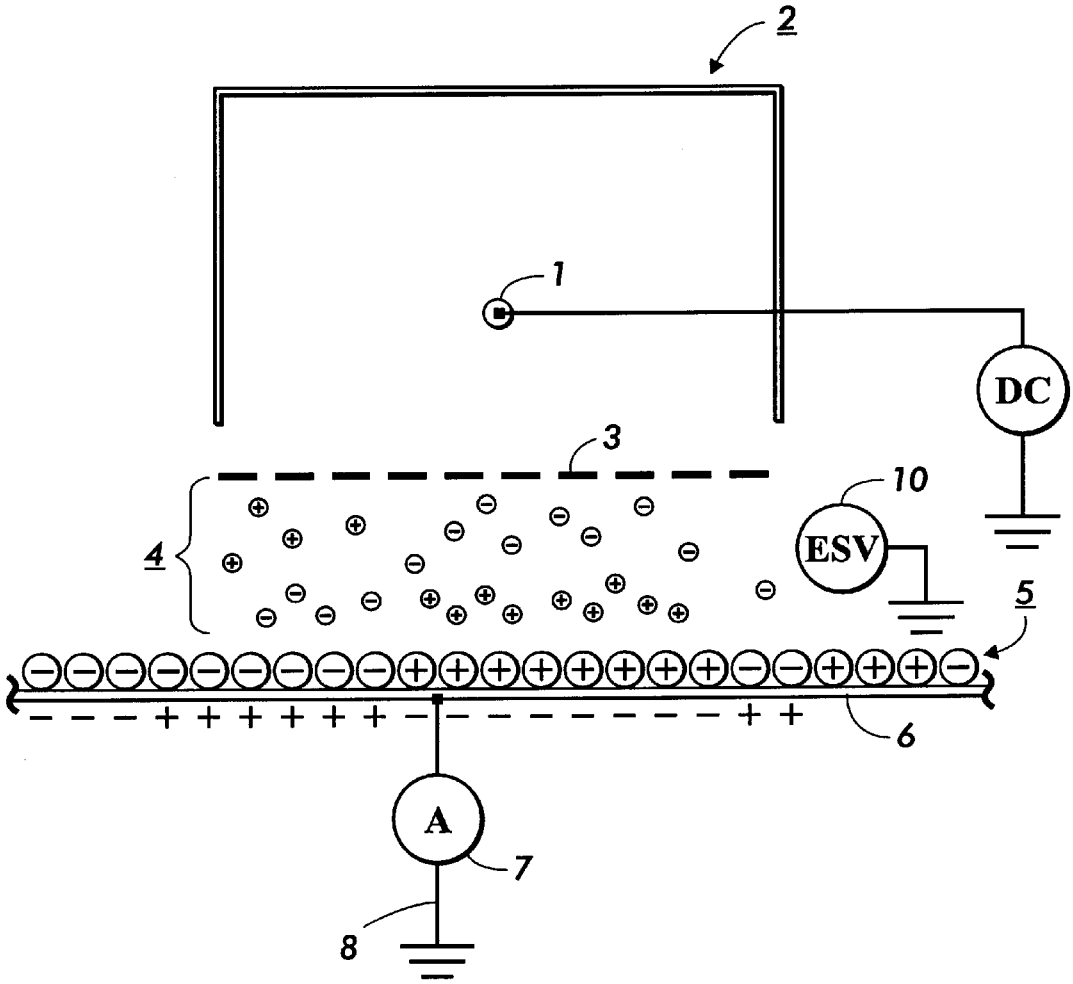
FIG. 1 illustrates a charging current test device.

Examples of features of the present invention include:

It is a feature of the present invention to provide a liquid developer with many of the advantages illustrated herein.

Another feature of the present invention resides in the provision of a liquid developer capable of modulated particle charging with, for example, corona ions for image quality optimization.

It is a further feature of the invention to provide positively charged, and/or negatively charged liquid developers wherein there are selected as charge acceptance agents or charge acceptance additives cyclodextrins, inclusive of organic basic nitrogenous derivatives of cyclodextrins, or aluminum complexes.

It is still a further feature of the invention to provide positively, and negatively charged liquid developers wherein developed image defects, such as smearing, loss of resolution and loss of density, and color shifts in prints with magenta images overlaid with yellow images are eliminated or minimized.

Also, in another feature of the present invention there are provided positively charged liquid developers with certain charge acceptance agents that are in embodiments superior in some characteristics to liquid developers with no charge director in that they can be selected for RCP development, reference U.S. Pat. No. 5,826,147, the disclosure of which is totally incorporated herein by reference, and wherein there can be generated high quality images.

Furthermore, in another feature of the present invention there are provided liquid toners that enable excellent image characteristics, and which toners enhance the positive charge of the resin selected, such as ELVAX® based resins.

These and other features of the present invention can be accomplished in embodiments by the provision of liquid developers.

Aspects of the present invention relate to an imaging apparatus comprising an imaging member with an electrostatic latent image formed thereon, the imaging member containing a surface capable of supporting marking material;

an imaging device for generating the electrostatic latent image on the imaging member wherein the electrostatic latent image includes image areas defined by a first charge voltage and nonimage areas defined by a second charge voltage distinguishable from the first charge voltage;

a marking material supply apparatus for depositing marking material on the surface of the imaging member to form a marking material layer thereon adjacent the electrostatic latent image on the imaging member;

a charging source for selectively delivering charges to the marking material layer in an imagewise manner responsive to the electrostatic latent image on the imaging member to form a secondary latent image in the marking material layer containing image and nonimage areas corresponding to the electrostatic latent image on the imaging member; and a separator member for selectively separating portions of the marking material layer in accordance with the secondary latent image in the marking material layer to create a developed image corresponding to the electrostatic latent image formed on the imaging member, and wherein the marking material is comprised of developer containing an optional liquid, resin, colorant, and a charge acceptance additive of an aluminum complex of the formulas, or mixtures thereof

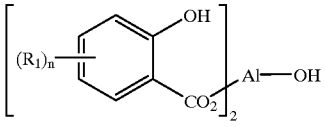

or

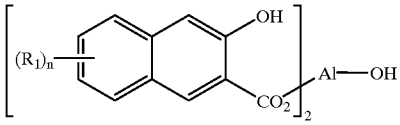

wherein $R_1$ is selected from the group consisting of hydrogen and alkyl, and n represents the number of $R_1$ groups; the imaging apparatus wherein the imaging member includes a photosensitive imaging substrate, and wherein the marking material is comprised of the resin, the colorant, and the charge acceptance component; the imaging apparatus wherein the imaging member includes a dielectric substrate; the imaging apparatus wherein the imaging member includes a support surface and an electroded substructure capable of generating charged latent image areas; the imaging apparatus further including a charging device for applying an electrostatic charge potential to the photosensitive imaging substrate; the imaging apparatus wherein the imaging device includes an image exposure device for projecting a light image onto the photosensitive imaging substrate to generate the electrostatic latent image; the imaging apparatus wherein the marking material supply apparatus is adapted to deposit a layer of uncharged marking particles on the surface of the imaging member, and wherein the marking particles are comprised of toner solids of the resin, the colorant, and the charge acceptance additive; the imaging apparatus wherein the marking material supply apparatus is adapted to deposit a layer of electrically charged marking particles on the surface of the imaging member; the imaging apparatus wherein the marking material supply apparatus is adapted to deposit a marking material layer having a thickness of from about 2 to about 15 microns on the surface of the imaging member; the imaging apparatus wherein the marking material supply apparatus deposits a marking material layer on the surface of the imaging member, and which layer possesses a thickness in a range of from about 3 to about 8 microns; the imaging apparatus wherein the marking material supply apparatus is adapted to accommodate the liquid developer material containing marking particles immersed in the liquid carrier medium, and wherein the marking particles contain the resin, the colorant, and the charge acceptance additive; the imaging apparatus wherein the marking material supply apparatus is adapted to deposit a marking material layer having a solids percentage by weight of at least about 10 percent; the imaging apparatus wherein the marking material supply apparatus is adapted to deposit a marking material layer having a solids percentage by weight in a range of from about 15 percent to about 35 percent, and wherein the solids contain resin, colorant, and charge acceptance additive; the imaging apparatus wherein the marking material supply apparatus is adapted to supply a marking material layer having a substantially uniform density onto the surface of the imaging member; the imaging apparatus wherein the marking material supply apparatus includes a housing adapted to accommodate a supply of marking particles therein; and a rotatably mounted applicator roll member for transporting marking particles from the housing to the surface of the imaging member; the imaging apparatus wherein the marking material supply apparatus further includes an electrical biasing source coupled to the applicator roll for applying an electrical bias thereto to generate electrical fields between the applicator roll and the imaging member thereby assisting in forming the marking material layer on the surface of the imaging member; the imaging apparatus wherein the marking material supply apparatus includes a fountain-type applicator assembly for transporting a flow of marking particles into contact with the surface of the imaging member; wherein the marking material supply apparatus further includes a metering roll for applying a shear force to the marking material layer on the surface of the imaging member to primarily control the thickness thereof; the imaging apparatus wherein the charge source is adapted to introduce free mobile ions in the vicinity of the imaging member with the electrostatic latent image and the marking material layer supported thereon, for creating an imagewise ion stream directed toward the marking material layer responsive to the electrostatic latent image on the imaging member; and optionally wherein the charging source includes a DC biasing source coupled thereto for providing a biasing voltage to the charging source to generate ions with a single charge polarity in the vicinity of the imaging member with the electrostatic latent image and the marking material layer supported thereon, and wherein the marking material is comprised of solids of the resin, the colorant, and the charge acceptance additive; the imaging apparatus wherein the charging source includes an AC biasing source coupled thereto for providing a biasing voltage to the charging source to generate ions having first and second charge polarities in the vicinity of the imaging member with the electrostatic latent image and the marking material layer supported thereon; and wherein the charging source further includes an optional DC biasing source coupled thereto for providing a DC offset to the biasing voltage; the imaging apparatus wherein the charging source includes an electrical biasing source coupled to an electrode member for providing a biasing voltage intermediate the first and second charge voltages associated with the electrostatic latent image generated on the imaging member; the imaging apparatus wherein the charging source includes an electrical biasing source coupled to an electrode member for providing a biasing voltage greater than the first and second charge voltages associated with the electrostatic latent image generated on the imaging member; the imaging apparatus wherein the charging source includes a plurality of independent ion generating devices; the imaging apparatus wherein the plurality of independent corona generating devices includes a first corona generating device for providing ions of a first charge polarity; and a second corona generating device for providing ions of a second charge polarity; the imaging apparatus wherein the separator member is adapted to attract marking material layer image areas associated with the secondary latent image away from the imaging member to maintain marking material layer nonimage areas or marking material layer image areas associated with the secondary latent image on the surface of the imaging member; the imaging apparatus wherein the separator member is adapted to attract marking material layer nonimage areas associated with the secondary latent image away from the imaging member to maintain marking material layer image areas associated with the secondary latent image on the surface of the imaging member; the imaging apparatus wherein the separator member includes a peripheral surface for contacting the marking material layer to selectively attract portions thereof away from the imaging member; or wherein the separator member includes an electrical biasing source coupled to the peripheral surface for electrically attracting selectively charged portions of the marking material layer; the imaging apparatus further including a transfer system for transferring the developed image to a copy substrate to thereby generate an output copy thereof; and wherein the transfer system further includes an optional component for substantially simultaneously fixing the image to the copy substrate; the imaging apparatus further including a fusing system for fusing the transferred image to the copy substrate, and further including a cleaning apparatus for removing marking material layer nonimage areas associated with the secondary latent image from the surface of the imaging member; the imaging apparatus further including a cleaning apparatus for removing marking material layer nonimage areas associated with the secondary latent image from the surface of the separator member; the imaging process comprising generating an electrostatic latent image on an imaging member with a surface capable of supporting toner particles, wherein the electrostatic latent image includes image areas encompassed by a first charge voltage and nonimage areas encompassed by a second charge voltage distinguishable from the first charge voltage;

depositing toner particles on the surface of the imaging member to form a toner layer thereon adjacent the image and nonimage areas of the electrostatic latent image;

selectively delivering charges to the toner layer in an imagewise manner responsive to the electrostatic latent image on the imaging member for forming a secondary latent image in the toner layer with image and nonimage areas corresponding to the electrostatic latent image on the imaging member; and selectively separating portions of the toner layer from the imaging member in accordance with the secondary latent image in the toner layer for creating a developed image corresponding to the electrostatic latent image formed on the imaging member, and wherein the toner particles are comprised of a resin, colorant, and a charge acceptance component comprised of an aluminum complex of the formulas, or mixtures thereof

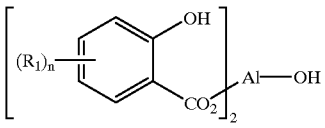

or

-continued

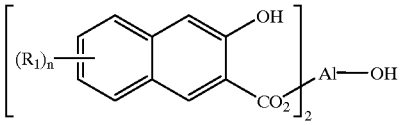

wherein $R_1$ is selected from the group consisting of hydrogen and alkyl, and n represents a number; the imaging process wherein the electrostatic latent image generating includes charging a photosensitive imaging substrate; and selectively dissipating the charge on the photosensitive imaging substrate in accordance with the image and nonimage areas; the imaging process wherein the electrostatic latent image generating includes selectively depositing electrical charge on a dielectric imaging member in accordance with the image and nonimage areas; and wherein the toner layer depositing includes optionally depositing a layer of uncharged or charged toner particles on the surface of the imaging member; the imaging process wherein the toner layer depositing includes depositing a layer of charged toner particles on the surface of the imaging member; the imaging process wherein the toner layer depositing includes forming a toner layer having a thickness of from about 2 to about 15 microns on the surface of the imaging member; the imaging process wherein the toner layer depositing includes forming a toner layer having a thickness in a range of from about 3 to about 8 microns on the surface of the imaging member; the imaging process wherein the toner layer depositing includes depositing liquid developing material containing toner particles immersed in a liquid carrier medium; the imaging process wherein the toner layer depositing is adapted to deposit a toner layer having a toner solids percentage by weight of at least about 10 percent, and wherein the toner solids contain the resin, the colorant, and the charge acceptance additive; the imaging process wherein the toner layer depositing is adapted to deposit a toner layer having a toner solids percentage by weight in a range of from about 15 percent to about 35 percent; the imaging process wherein the toner layer depositing is adapted to deposit a toner layer having a substantially uniform density onto the surface of the imaging member; the imaging process wherein selectively delivering charges to the toner layer is adapted to introduce free mobile ions in the vicinity of the imaging member with the electrostatic latent image and the toner layer supported thereon, for creating an imagewise ion stream directed toward the toner layer responsive to the electrostatic latent image on the imaging member; the imaging process wherein the selectively delivering charges to the toner layer is adapted to generate ions having a single charge polarity in the vicinity of the imaging member having the electrostatic latent image and the toner layer supported thereon; the imaging process wherein the selectively delivering charges to the toner layer is adapted to generate ions having first and second charge polarities in the vicinity of the imaging member with the electrostatic latent image and the toner layer supported thereon; an image development apparatus comprising means for depositing a layer of marking particles on an imaging member;

means for creating an electrical discharge in a vicinity of the layer of marking particles on the imaging member to selectively charge the layer of marking particles in response to the electrostatic latent image on the imaging member to thereby create a second electrostatic latent image in the layer of marking particles; and means for selectively separating portions of the layer of marking particles in accordance with the second latent image for creating a developed image corresponding to the electrostatic latent image formed on the imaging member, and wherein the marking material is comprised of thermoplastic resin, colorant, and a charge acceptance agent comprised of an aluminum complex represented by the following formulas, or mixtures thereof

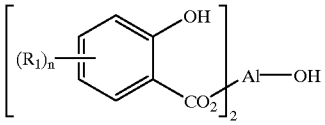

or

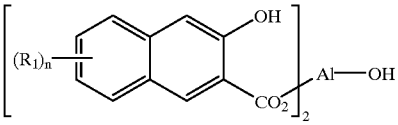

wherein $R_1$ is selected from the group consisting of hydrogen and alkyl, and n represents a number; a process for image development comprising the steps of generating a first electrostatic latent image on an imaging member wherein the electrostatic latent image includes image and nonimage areas having distinguishable charge potentials; and generating a second electrostatic latent on a toner layer situated adjacent the first electrostatic latent image on the imaging member, wherein the second electrostatic latent image includes image and nonimage areas having distinguishable charge potentials of a polarity opposite to the charge potentials of the charged image and nonimage areas in the first electrostatic latent image and wherein the toner layer is comprised of thermoplastic resin, colorant, and a charge acceptance agent encompassed by the formulas

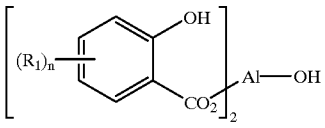

or

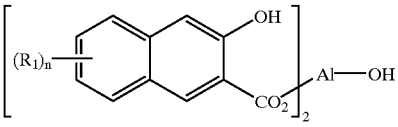

wherein $R_1$ is selected from the group consisting of hydrogen and alkyl, and n represents a number; an apparatus wherein the developer contains the liquid with a viscosity of from about 0.5 to about 500 centipoise and resistivity equal to or greater than about $5\times10^9$, and the resin particles optionally possess a volume average particle diameter of from about 0.1 to about 30 microns; an apparatus wherein the resin is a copolymer of ethylene and methacrylic acid; an apparatus wherein the colorant is present in an amount of from about zero (0) to about 60 percent by weight based on the total weight of developer solids of resin, colorant, and charge acceptance additive; an apparatus wherein the colorant is carbon black, cyan, magenta, yellow, red, green, blue, orange, violet, brown or mixtures thereof; an apparatus wherein the charge acceptance component is present in an amount of from about 0.05 to about 10 weight percent based on the weight of the developer solids of resin, colorant, and charge acceptance additive; an apparatus wherein the developer contains a liquid of an aliphatic hydrocarbon; an apparatus wherein the aliphatic hydrocarbon is a mixture of branched hydrocarbons of from about 8 to about 16 carbon atoms, or a mixture of normal hydrocarbons of from about 8 to about 16 carbon atoms; an apparatus wherein the aliphatic hydrocarbon is a mixture of branched hydrocarbons of from about 8 to about 16 carbon atoms; an apparatus wherein the resin is an alkylene polymer, a styrene polymer, an acrylate polymer, a polyester, or mixtures thereof; an apparatus wherein the developer further contains suitable additives; an apparatus wherein the colorant is present in an amount of from about 3 to about 55 weight percent; an apparatus wherein the charge acceptance additive is aluminum di-tertiary-butyl salicylate; hydroxy bis[3,5-tertiary butyl salicylic]aluminate; hydroxy bis[3,5-tertiary butyl salicylic]aluminate mono-, di-, tri- or tetrahydrates; hydroxy bis[salicylic]aluminate; hydroxy bis[monoalkyl salicylic] aluminate; hydroxy bis[dialkyl salicylic]aluminate; hydroxy bis[trialkyl salicylic]aluminate; hydroxy bis[tetraalkyl salicylic]aluminate; hydroxy bis[hydroxy naphthoic acid] aluminate; hydroxy bis[monoalkylated hydroxy naphthoic acid]aluminate; bis[dialkylated hydroxy naphthoic acid] aluminate; bis[trialkylated hydroxy naphthoic acid] aluminate; or bis[tetraalkylated hydroxy naphthoic acid] aluminate; an apparatus wherein the charge acceptance component is hydroxy bis(3,5-di-tertiary butyl salicylic) aluminate; an apparatus wherein the $R_1$ is hydrogen; an apparatus wherein the $R_1$ is alkyl; an apparatus wherein the $R_1$ is alkyl with 1 to about 25 carbon atoms; an apparatus wherein the $R_1$ is alkyl with 1 to about 12 carbon atoms; an apparatus wherein the $R_1$ alkyl is methyl, propyl, butyl, ethyl, pentyl, isomers thereof, or mixtures thereof; an apparatus wherein the charge acceptance component is present in an amount of from about 0.05 to about 10 weight percent based on the weight of the developer solids of resin, colorant, and charge acceptance component; an apparatus wherein the charge acceptance additive is of the formula

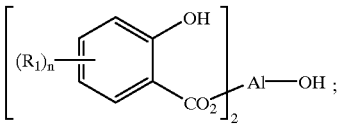

an apparatus wherein the charge acceptance component is of the formula

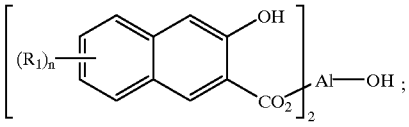

a process wherein the charge acceptance component is of the formula

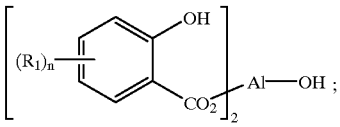

a process wherein the charge acceptance additive is of the formula

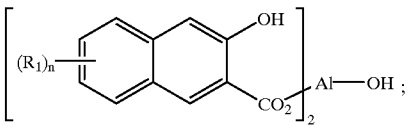

a process wherein n is a number of from 1 to about 4; a process wherein n is a number of from 1 to about 3; liquid developers comprised of a nonpolar liquid, resin, preferably a thermoplastic resin, as a charge acceptor the aluminum salts of alkylated salicylic acid, like, for example, hydroxy bis[3,5-tertiary butyl salicylic]aluminate, or mixtures thereof, optionally also containing EMPHOS PS-900™, reference U.S. Pat. No. 5,563,015, the disclosure of which is totally incorporated herein by reference, or as a charge acceptor a cyclodextrin component. In embodiments thereof of the present invention the liquid developers can be charged in a device which first charges the developer to a first polarity, such as a positive polarity, followed by a second charging with a second charging device to reverse the developer charge polarity, such as to a negative polarity in an imagewise manner. Subsequently, a biased image bearer, (IB) separates the image from the background corresponding to the charged image pattern in the toner, or developer layer. Thus, the liquid developers are preferably charged by bipolar ion charging (BIC) rather than with chemical charging.

Cyclodextrins and their nitrogenous derivatives can be selected as the nonpolar medium insoluble charge acceptance agent, and which charge acceptance agent is capable of capturing either negative or positive ions to provide either negative or positively charged liquid developers and preferably wherein the cyclodextrins, or derivatives thereof capture positive ions. Although not being desired to be limited by theory, it is believed that non-bonded electron pairs on neutral nitrogen atoms (usually amine functional groups but not limited thereto) which reside at the openings of the cyclodextrin cavity capture positive ions from the corona effluent by forming covalent or coordinate covalent (dative) bonds with the positive ions. The neutral nitrogen atom in the cyclodextrin molecule then becomes a positively charged nitrogen atom and therefore the cyclodextrin charge acceptor molecule itself becomes positively charged. Since the positively charged cyclodextrin molecule resides in the immobile toner particle and not in the mobile phase or liquid carrier, the immobile toner layer itself on the dielectric surface becomes positively charged in an imagewise manner dependent upon the charge acceptor molecule concentration. As the charge acceptor concentration can be the same throughout the toner layer, it is the amount of toner at a given location in the toner layer that controls the amount of charge acceptor and charge at that location. The amount of charge at a given location then results in differential development (due to different potentials) in accordance with the imagewise pattern deposited on the dielectric surface.

In addition to the above-described nitrogen (positive) charge acceptance mechanism, two other mechanisms may coexist when using cyclodextrin charge acceptor molecules, with or without nitrogen groups present. These mechanisms involve corona ion-acceptance (both involving both ion polarities) or acceptance of ions derived from the interaction of corona ions with other components in the toner layer. One mechanism involves the hydroxyl groups, present at the cavity entrances in the cyclodextrin molecules, which can capture either positive or negative corona effluent ions or species derived therefrom. In regard to the hydroxyl charge (ion) acceptance mechanism, it is believed that nonbonded electron pairs on one or more of the oxygen atoms in adjacent hydroxyl groups can bond positive ions from the corona effluent or from species derived therefrom, from which there results a positive charge dispersed on one or more hydroxyl oxygen atoms. Although the strength of a hydroxyl oxygen-positive ion bond is not as large as that of the amine nitrogen-positive ion bond, multiple oxygen atoms can participate at any given instant in time to complex the positive ion thereby resulting in a sufficient bonding force to acquire permanent positive charging. Optionally, the positive ion from the corona effluent or from species derived therefrom can bind to only one hydroxyl oxygen atom, however, the positive ion can then migrate around all the hydroxyl oxygen atoms surrounding the cyclodextrin cavity opening thereby providing positive charge stability by a charge dispersal mechanism. Also, in the hydroxyl oxygen-positive ion bonding mechanism, the hydroxyl group hydrogen atom is further capable of hydrogen bonding to negative ions originating from the corona effluent or from species derived therefrom. Thus, the hydroxyl group itself is ambivalent in its ability to chemically bind positive and negative ions. In the hydroxyl hydrogen bonding mechanism, hydrogen bonding is an on again-off again mechanism referring, for example, to when one hydrogen bond forms and then breaks there is an adjacent hydroxyl hydrogen atom that replaces the first broken hydrogen bond so that hydrogen bonding charge dispersion occurs to again provide charge stability by a charge dispersal mechanism. In the second mechanism, corona ion fragments (either polarity) or species derived therefrom that are small enough can become physically entrapped inside the cyclodextrin cavity opening resulting in a charged cyclodextrin molecule and hence again a charged toner layer. This ion trapping mechanism is specific to the steric size of the ion or ions emanating from the corona effluent or from species derived therefrom. Ions should be able to fit into the cavity opening to be entrapped, and ions too large cannot enter the cavity opening, will not be entrapped and will not charge the toner layer by this mechanism. Ions that are too small to rapidly pass into and out of the cyclodextrin cavity opening and are not entrapped for a significant time period, will not charge the toner layer by the aforementioned entrapment mechanism. These inappropriately sized ions however could ultimately charge the toner layer as indicated herein. Also, some of the corona effluent ions may have first interacted with other toner layer components to produce secondary ions that are captured by the cyclodextrin charge acceptance molecules. However, any secondary ion formation that might occur should not be too extensive to cause a degradation of the polymeric toner resin or the colorant during the toner layer charging, and wherein the toner layer retains its integrity and the colorant its color strength.

With regard to the aluminum salts, illustrated herein and the appropriate patents mentioned herein, such as the carboxylate salts selected as charge acceptance additives, preferably at least one of the toner resins in the developer contains a functional group capable of covalently bonding to the aluminum charge acceptance agent. Typical functional groups include a carboxylic acid and a hydroxyl group. Examples of resins with functional groups are carboxylic acid containing resins such as the NUCREL resins available from E.I. DuPont. When the carboxylic acid group in the resin forms a covalent bond with the aluminum containing charge acceptance agent, it is believed that the carboxylic acid group anchors the charge acceptance agent to the toner resin in the solid phase. Thus, when the charge acceptance agent accepts an ionic charge from the corona discharge or from species derived therefrom, the ionic charge is also anchored in the solid phase of the liquid toner. Since only toner particles then become charged, the concentration of free mobile ions in the developer liquid phase is avoided or minimized. The avoidance of mobile ions in the liquid phase is desirable since they interfere with BIC-RCP development. This type of charge acceptance agent preferentially accepts negative ions, wherein the negative ions frequently contain one or more negative oxygen atoms, to provide a negatively charged liquid developer. The aluminum salts generally accept oxygen nucleophiles (preferentially as a negative oxygen anion) from the corona effluent by forming a fourth covalent bond between the oxygen nucleophile and the aluminum atom, thereby generating a negative aluminum atom which renders the aluminum-containing molecule negatively charged. Acceptance of positive ions, generated from the corona effluent or from species derived therefrom, by an aluminum carboxylate charge acceptor may occur to generate positively charged aluminum-containing molecules. Three bonding mechanisms are plausible between positive ions and the aluminum carboxylate charge acceptors and which generate positively charged aluminum-containing molecules and a positively charged toner layer. Although not being desired to be limited by theory, (1) a low steady-state concentration of free carboxylate anions, dissociated from the aluminum carboxylate complex but contained therein, could accept positive ions; (2) the aluminum carboxylate complex positive ion acceptance mechanism could also occur by positive ion-hydrogen bonding with water of hydration surrounding the aluminum carboxylate charge acceptor; and (3) the aluminum carboxylate complex positive ion acceptance mechanism could also be accomplished by positive ion-hydrogen bonding with hydroxyl groups, attached to the aluminum atom in the aluminum carboxylate complex.

While not being desired to be limited by theory, capturing charge using a charge acceptance agent versus a charge control agent is different mechanistically. A first difference resides in the origin and location of the species reacting with a charge acceptance agent versus the origin and location of the species reacting with a charge control agent. The species reacting with a charge acceptance agent originate in the corona effluent, which after impinging on the toner layer, become trapped in the solid phase thereof. The species reacting with a charge control agent, i.e. the charge director originates by purposeful formulation of the charge director into the liquid developer and remains soluble in the liquid phase of the toner layer. Both the charge acceptance agent (in BIC-RCP developers) and the charge control additive or agent (in chemically charged developers) are insoluble in the liquid developer medium and reside on and in the toner particles, however, charge directors used for chemically charged developers, dissolve in the developer medium. A second difference between a charge acceptance agent and a charge director is that charge directors in chemically charged liquid developers charge toner particles to the desired polarity, while at the same time capturing the charge of opposite polarity so that charge neutrality is maintained during this chemical equilibrium process. Charge separation occurs only later when the developer is placed in an electric field during development. In the BIC-RCP development process, the corona effluent used to charge the liquid developer is generated from any corona generating device and the dominant polarity of the effluent is fixed by the device. Corona ions first reach the surface of the toner layer, move through the liquid phase, and are adsorbed onto the toner particle and captured by the charge acceptance agent. The mobile or free corona ions in the liquid phase rapidly migrate to the ground plane. Some of these mobile ions may include counterions, if counter ions are formed in the charging process. Counterions bear the opposite polarity charge versus the charged toner particles in the developer. The corona ions captured by the charge acceptance agent in or on the toner charge the developer to the same polarity as the dominant polarity charge in the corona effluent. The ion-charged liquid developer particles remain charged and most counter-ions, if formed in the process, exit to the ground plane so fewer counter charges remain in the developer layer. Electrical neutrality or equilibrium is not usually attained in the BIC-RCP development process and development is not usually interfered with by species containing counter charges.

The slightly soluble charge acceptance agent initially resides in the liquid phase but prior to charging the toner layer the charge acceptance agent preferably deposits on the toner particle surfaces. The concentration of charge acceptor in the nonpolar solvent is believed to be close to the charge acceptor insolubility limit at ambient temperature especially in the presence of toner particles. The adsorption affinity between soluble charge acceptor and insoluble toner particles is believed to accelerate charge acceptor adsorption such that charge acceptor insolubility occurs at a lower charge acceptor concentration versus when toner particles are not present. When the insoluble or slightly soluble charge acceptors accept (chemically bind) ions from the impinging corona effluent (BIC) or from species derived therefrom, there is obtained a net charge on the toner particles in the liquid developer. Since the toner layer contains charge acceptors capable of capturing both positive and negative ions, the net charge on the toner layer is not determined by the charge acceptor but instead is determined by the predominant ion polarity emanating from the corona. Corona effluents rich in positive ions give rise to charge acceptor capture of more positive ions, and therefore, provide a net positive charge to the toner layer. Corona effluents rich in negative ions give rise to charge acceptor capture of more negative ions, and therefore, provide a net negative charge to the toner layer.

A difference in the charging mechanism of a charge acceptance agent versus is that after charging a liquid developer via the standard charge director (chemical charging) mechanism, the developer contains an equal number of charges of both polarity. An equal number of charges of both polarities in the developer hinders reverse charge imaging, so adding a charge director to the developer before depositing the uncharged developer onto the dielectric surface is undesirable. However, if corona ions in the absence of a charge director are used to charge the toner layer, the dominant ion polarity in the effluent will be accepted by the toner particles to a greater extent resulting in a net toner charge of the desired polarity and little if any counter-charged particles. When the toner layer on the dielectric receiver has more of one kind (positive or negative) of charge on it, reverse charge imaging is facilitated.

Of importance with respect to the present invention is the presence in the liquid developer of the charge acceptor, for example, the aluminum salts illustrated herein, cyclodextrins, and the like, which agents function to for example, increase the Q/M of both positive and negatively charged developers. The captured charge can be represented by $Q=fCV$ where C is the capacitance of the toner layer, V is the measured surface voltage, and f is a proportionality constant which is dependent upon the distribution of captured charge in the toner layer. M in Q/M is the total mass of the toner solids. It is believed that with the developers of the present invention in embodiments all charges are associated with the solid toner particles.

Examples of charge acceptance additives present in various effective amounts of, for example, from about 0.001 to about 10, and preferably from about 0.01 to about 7 weight percent or parts, include cyclodextrins, aluminum di-tertiary-butyl salicylate; hydroxy bis[3,5-tertiary butyl salicylic]aluminate; hydroxy bis[3,5-tertiary butyl salicylic] aluminate mono-, di-, tri- or tetrahydrates; hydroxy bis [salicylic]aluminate; hydroxy bis[monoalkyl salicylic] aluminate; hydroxy bis[dialkyl salicylic]aluminate; hydroxy bis[trialkyl salicylic]aluminate; hydroxy bis[tetraalkyl salicylic]aluminate; hydroxy bis[hydroxy naphthoic acid] aluminate; hydroxy bis[monoalkylated hydroxy naphthoic acid]aluminate; bis[dialkylated hydroxy naphthoic acid] aluminate wherein alkyl preferably contains 1 to about 6 carbon atoms; bis[trialkylated hydroxy naphthoic acid] aluminate wherein alkyl preferably contains 1 to about 6 carbon atoms; and bis[tetraalkylated hydroxy naphthoic acid]aluminate wherein alkyl preferably contains 1 to about 6 carbon atoms. Generally, the aluminum complex charge acceptor can be considered a nonpolar liquid insoluble or slightly soluble organic aluminum complex, or mixtures thereof of Formula II and which additives can be optionally selected in admixtures with those components of Formula I

I.

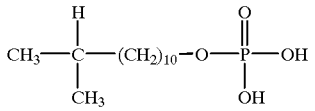

mono

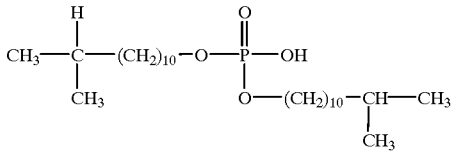

di

II.

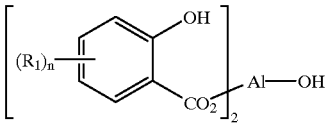

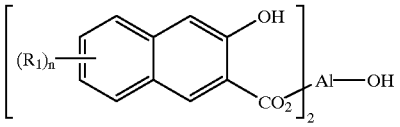

wherein $R_1$ is selected from the group consisting of hydrogen and alkyl, and n represents a number, such as from about 1 to about 4, reference for example U.S. Pat. No. 5,672,456, the disclosure of which is totally incorporated herein by reference.

Cyclodextrins can be considered cyclic carbohydrate molecules comprised, for example, of 6, 7, or 8 glucose units, or segments which represent alpha, beta and gamma cyclodextrins, respectively, configured into a conical molecular structure with a hollow internal cavity. The chemistry of cyclodextrins is described in "*Cyclodextrin Chemistry*" by M. L. Bender and M. Komiyama, 1978, Springer-Verlag., the disclosure of which is totally incorporated herein by reference. The alpha and beta, the preferred cyclodextrin for the liquid developers of the present invention, and gamma cyclodextrins are also known as cyclohexaamylose and cyclomaltohexaose, cycloheptaamylose and cyclomaltoheptaose, and cyclooctaamylose and cyclomaltooctaose, respectively, can be selected as the charge acceptor additives. The hollow interiors provide these cyclic molecules with the ability to complex and contain, or trap a number of molecules or ions, such as positively charged ions like benzene ring containing hydrophobic cations, which insert themselves into the cyclodextrin cavities. In addition, modified cyclodextrins or cyclodextrin derivatives may also be used as the charge acceptance agents for the liquid developer of the present invention. In particular, cyclodextrin molecular derivatives containing basic organic functional groups, such as amines, amidines and guanidines, also trap protons via the formation of protonated nitrogen cationic species.

Specific examples of cyclodextrins, many of which are available from American Maize Products Company now Cerestar Inc., include the parent compounds, alpha cyclodextrin, beta cyclodextrin, and gamma cyclodextrin, and branched alpha, beta and gamma cyclodextrins, and substituted alpha, beta and gamma cyclodextrin derivatives having varying degrees of substitution. Alpha, beta and gamma cyclodextrin derivatives include 2-hydroxyethyl cyclodextrin, 2-hydroxypropyl cyclodextrin, acetyl cyclodextrin, methyl cyclodextrin, ethyl cyclodextrin, succinyl beta cyclodextrin, nitrate ester of cyclodextrin, N,N-diethylamino-N-2-ethyl cyclodextrin, N,N-morpholino-N-2-ethyl cyclodextrin, N,N-thiodiethylene-N-2-ethyl-cyclodextrin, and N,N-diethyleneaminomethyl-N-2-ethyl cyclodextrin wherein the degree of substitution can vary from 1 to 18 for alpha cyclodextrin derivatives, 1 to 21 for beta cyclodextrin derivatives, and 1 to 24 for gamma cyclodextrin derivatives. The degree of substitution is the extent to which cyclodextrin hydroxyl hydrogen atoms were substituted by the indicated named substituents in the derivatized cyclodextrins. Mixed cyclodextrin derivatives, containing 2 to 5 different substituents, and from 1 to 99 percent of any one substituent may also be used.

Additional alpha, beta, and gamma cyclodextrin derivatives include those prepared by reacting monochlorotriazinyl-beta-cyclodextrin, available from Wacker-Chemie GmbH as beta W7 MCT and having a degree of substitution of about 2.8, with organic basic compounds such as amines, amidines, and guanidines. Amine intermediates for reaction with the monochlorotriazinyl-beta-cyclodextrin derivative include molecules containing a primary or secondary aliphatic amine site, and a second tertiary aliphatic amine site within the same molecule so that after nucleophilic displacement of the reactive chlorine in the monochlorotriazinyl-beta-cyclodextrin derivative has occurred, the resulting cyclodextrin triazine product retains its free tertiary amine site (for proton acceptance) even though the primary or secondary amine site was consumed in covalent attachment to the triazine ring. In addition, the amine intermediates may be difunctional in primary and/or secondary aliphatic amine sites and mono or multi-functional in tertiary amine sites so that after nucleophilic displacement of the reactive chlorine in the monochlorotriazinyl-beta-cyclodextrin derivative has occurred, polymeric forms of the resulting cyclodextrin triazine product result. Preferred amine intermediates selected to react with the monochlorotriazinyl-beta-cyclodextrin derivative to prepare tertiary amine bearing cyclodextrin derivatives include 4-(2-aminoethyl) morpholine, 4-(3-aminopropyl) morpholine, 1-(2-aminoethyl) piperidine, 1-(3-aminopropyl)-2-piperidine, 1-(2-aminoethyl) pyrrolidine, 2-(2-aminoethyl)-1-methylpyrrolidine, 1-(2-aminoethyl) piperazine, 1-(3-aminopropyl) piperazine, 4-amino-1-benzylpiperidine, 1-benzylpiperazine, 4-piperidinopiperidine, 2-dimethylaminoethyl amine, 1,4-bis(3-aminopropyl) piperazine, 1-(2-aminoethyl)piperazine, 4-(aminomethyl) piperidine, 4,4'-trimethylene dipiperidine, and 4,4'-ethylenedipiperidine. Preferred amidine and guanidine intermediates selected to react with the monochlorotriazinyl-beta-cyclodextrin derivative to prepare amidine and guanidine bearing cyclodextrin triazine CCA products after neutralization include formamidine acetate, formamidine hydrochloride, acetamidine hydrochloride, benzamidine hydrochloride, guanidine hydrochloride, guanidine sulfate, 2-guanidinobenzimidazole, 1-methylguanidine hydrochloride, 1,1-dimethylguanidine sulfate, and 1,1,3,3-tetramethylguanidine. Mixed cyclodextrins derived from the monochlorotriazinyl-beta-cyclodextrin derivative may contain 2 to 5 different substituents, and from 1 to 99 percent of any one substituent in this invention.

Cyclodextrins charge acceptance components include, for example, those of the formulas

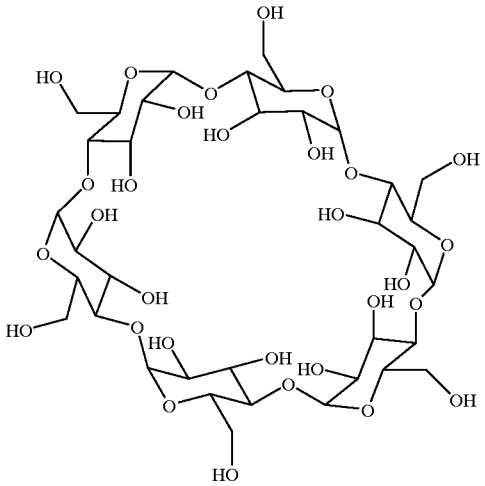

alpha-Cyclodextrin: 6 D-glucose rings containing-18 hydroxyl groups

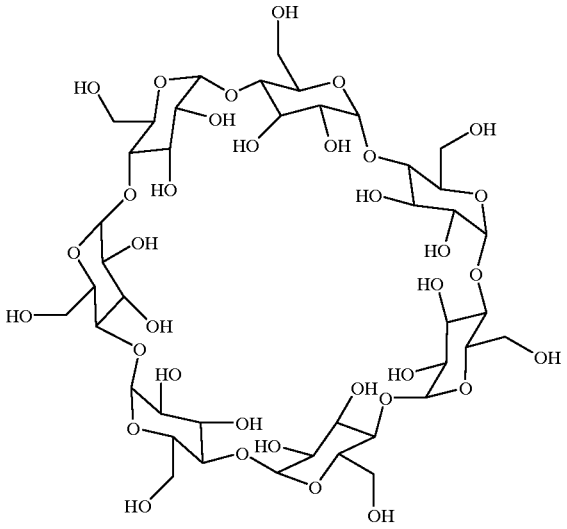

beta-Cyclodextrin: 7 D-glucose rings containing 21 hydroxyl groups

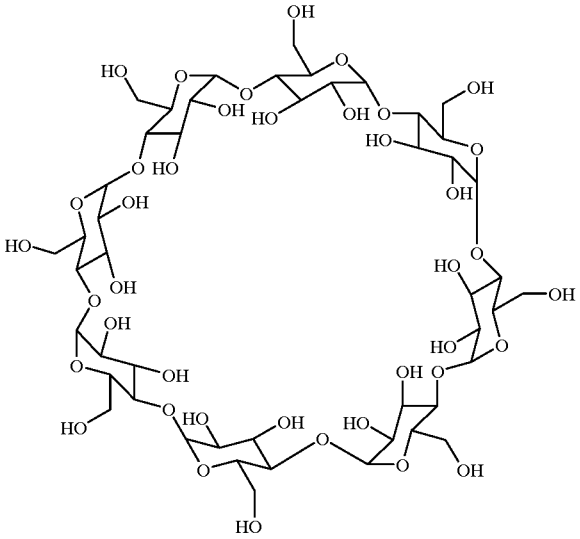

gamma-Cyclodextrin: 8 D-glucose rings containing 24 hydroxyl groups

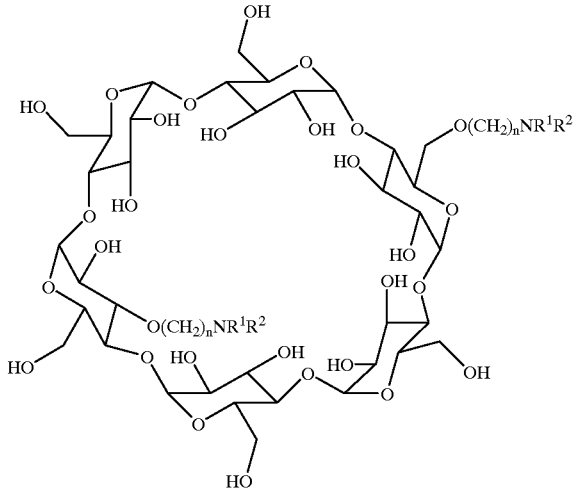
Tertiary Amino Alpha Cyclodextrin
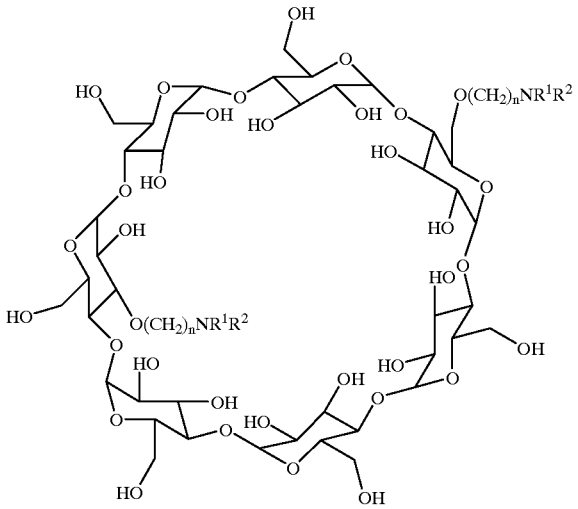
Tertiary Amino Beta Cyclodextrin; and
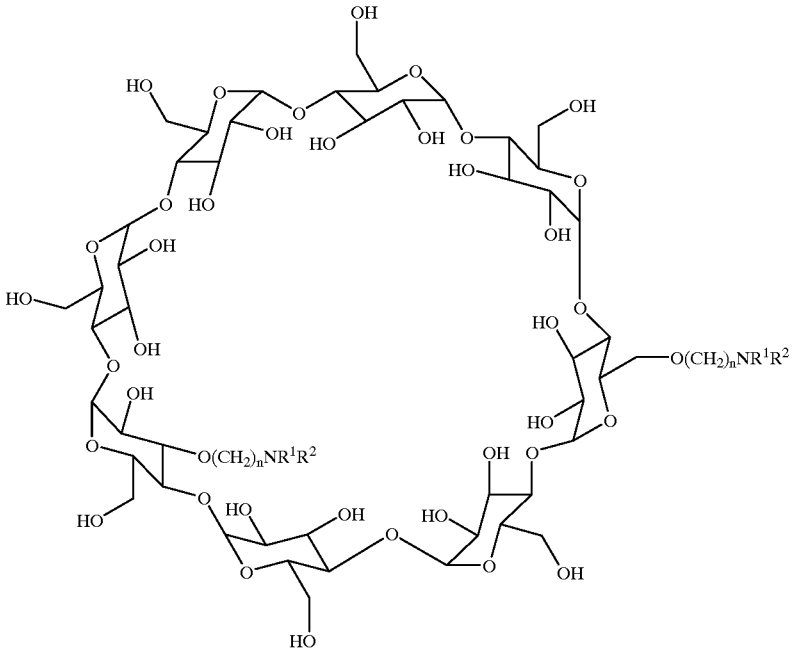
Tertiary Amino Gamma Cyclodextrin In embodiments of the present invention, the charge acceptance component or agent, such as the cyclodextrin, is selected in various effective amounts, such as for example from about 0.01 to about 10, and preferably from about 1 to about 7 weight percent based primarily on the total weight percent of the solids, of resin, colorants, and cyclodextrin, or other charge acceptor, and wherein the total of all solids is preferably from about 1 to about 25 percent and the total of nonpolar liquid carrier present is about 75 to about 99 percent based on the weight of the total liquid developer. The toner solids preferably contains in embodiments about 1 to about 7 percent cyclodextrin, about 15 to about 60 percent colorant, and about 33 to about 83 percent resin.

Examples of nonpolar liquid carriers or components selected for the developers of the present invention include a liquid with an effective viscosity of, for example, from about 0.5 to about 500 centipoise, and preferably from about 1 to about 20 centipoise, and a resistivity equal to or greater than, for example, $5\times10^{9}$ ohm/cm, such as $5\times10^{13}$. Preferably, the liquid selected is a branched chain aliphatic hydrocarbon. A nonpolar liquid of the ISOPAR® series (manufactured by the Exxon Corporation) may also be used for the developers of the present invention. These hydrocarbon liquids are considered narrow portions of isoparaffinic hydrocarbon fractions with extremely high levels of purity. For example, the boiling range of ISOPAR G® is between about 157° C. and about 176° C.; ISOPAR H® is between about 176° C. and about 191° C.; ISOPAR K® is between about 177° C. and about 197° C.; ISOPAR L® is between about 188° C. and about 206° C.; ISOPAR M® is between about 207° C. and about 254° C.; and ISOPAR V® is between about 254.4° C. and about 329.4° C. ISOPAR L® has a mid-boiling point of approximately 194° C. ISOPAR M® has an auto ignition temperature of 338° C. ISOPAR G® has a flash point of 40° C. as determined by the tag closed cup method; ISOPAR H® has a flash point of 53° C. as determined by the ASTM D-56 method; ISOPAR L® has a flash point of 61° C. as determined by the ASTM D-56 method; and ISOPAR M® has a flash point of 80° C. as determined by the ASTM D-56 method. The liquids selected are generally known and should have an electrical volume resistivity in excess of $10^{9}$ ohm-centimeters and a dielectric constant below 3.0 in embodiments of the present invention. Moreover, the vapor pressure at 25° C. should be less than 10 Torr in embodiments.

While the ISOPAR® series liquids may be the preferred nonpolar liquids for use as dispersant in the liquid developers of the present invention, the important characteristics of viscosity and resistivity may be achievable with other suitable liquids. Specifically, the NORPAR® series available from Exxon Corporation, the SOLTROL® series available from the Phillips Petroleum Company, and the SHELLSOL® series available from the Shell Oil Company can be selected.

The amount of the liquid employed in the developer of the present invention is preferably, for example, from about 80 to about 99 percent, and most preferably from about 85 to about 95 percent by weight of the total liquid developer. The liquid developer is preferably comprised of fine toner particles, or toner solids, and nonpolar liquid. The total solids which include resin, components such as adjuvants, optional colorants, and the cyclodextrin or aluminum complex charge acceptance agent, content of the developer in embodiments is, for example, 0.1 to 20 percent by weight, preferably from about 3 to about 17 percent, and more preferably, from about 5 to about 15 percent by weight. Dispersion is used to refer to the complete process of incorporating a fine particle into a liquid medium such that the final product consists of fine toner particles distributed throughout the medium. Since liquid developers are comprised of fine particles dispersed in a nonpolar liquid, it is often referred to as dispersion.

Typical suitable thermoplastic toner resins that can be selected for the liquid developers of the present invention in effective amounts, for example, in the range of about 99.9 percent to about 40 percent, and preferably 80 percent to 50 percent of developer solids comprised of thermoplastic resin, charge acceptance component, and optional, and in embodiments other components that may comprise the toner. Generally, developer solids include the thermoplastic resin, optional charge additive, colorant, and charge acceptance agent. Examples of resins include ethylene vinyl acetate (EVA) copolymers (ELVAX® resins, E.I. DuPont de Nemours and Company, Wilmington, Del.); copolymers of ethylene and an alpha, beta-ethylenically unsaturated acid selected from the group consisting of acrylic acid and methacrylic acid; copolymers of ethylene (80 to 99.9 percent), acrylic or methacrylic acid (20 to 0.1 percent)/alkyl (C1 to C5) ester of methacrylic or acrylic acid (0.1 to 20 percent); polyethylene; polystyrene; isotactic polypropylene (crystalline); ethylene ethyl acrylate series available as BAKELITE® DPD 6169, DPDA 6182 NATURAL™ (Union Carbide Corporation, Stamford, Conn.; ethylene vinyl acetate resins like DQDA 6832 Natural 7 (Union Carbide Corporation); SURLYN® ionomer resin (E.I. DuPont de Nemours and Company); or blends thereof; polyesters; polyvinyl toluene; polyamides; styrene/butadiene copolymers; epoxy resins; acrylic resins, such as a copolymer of acrylic or methacrylic acid, and at least one alkyl ester of acrylic or methacrylic acid wherein alkyl is 1 to 20 carbon atoms, such as methyl methacrylate (50 to 90 percent)/methacrylic acid (0 to 20 percent)/ethylhexyl acrylate (10 to 50 percent); and other acrylic resins including ELVACITE® acrylic resins (E.I. DuPont de Nemours and Company); or blends thereof.

The liquid developers of the present invention preferably contain a colorant dispersed in the resin particles. Colorants, such as pigments or dyes and mixtures thereof may be present to render a latent image visible.

The colorant may be present in the developer in an effective amount of, for example, from about 0.1 to about 60 percent, and preferably from about 15 to about 60, and in embodiments about 25 to about 45 percent by weight based on the total weight of solids contained in the developer. The amount of colorant used may vary depending on the use of the developer. Examples of pigments which may be selected include carbon lacks available from, for example, Cabot Corporation, FANAL PINK™, PV FAST BLUE™, those pigments as illustrated in U.S. Pat. No. 5,223,368, the disclosure of which is totally incorporated herein by reference; other known pigments; and the like. Dyes are known and include food dyes.

To further increase the toner particle charge and, accordingly, increase the transfer latitude of the toner particles, charge adjuvants can be added to the developer. For example, adjuvants, such as metallic soaps like or magnesium stearate or octoate, fine particle size oxides, such as oxides of silica, alumina, titania, and the like paratoluene sulfonic acid, and polyphosphoric acid, may be added. These types of adjuvants can assist in enabling improved toner charging characteristics, namely, an increase in particle charge that results in improved image development and transfer to allow superior image quality with improved solid area coverage and resolution in embodiments. The adjuvants can be added to the developer in an amount of from about 0.1 percent to about 15 percent of the total developer solids, and preferably from about 3 percent to about 7 percent of the total weight percent of solids contained in the developer.

The liquid electrostatic developer of the present invention can be prepared by a variety of processes such as, for example, mixing in a nonpolar liquid the thermoplastic resin, charge acceptance component, optional charge additives, such as charge adjuvants, and colorant in a manner that the resulting mixture contains, for example, about 30 to about 60 percent by weight of solids; heating the mixture to a temperature of from about 40° C. to about 110° C. until a uniform dispersion is formed; adding an additional amount of nonpolar liquid sufficient to decrease the total solids concentration of the developer to about 10 to about 30 percent by weight solids and isolating the developer by, for example, cooling the dispersion to about 10° C. to about 30° C. In the initial mixture, the resin, charge acceptance component, and optional colorant may be added separately to an appropriate vessel, such as, for example, an attritor, heated ball mill, heated vibratory mill, such as a Sweco Mill manufactured by Sweco Company, Los Angeles, Calif., equipped with particulate media for dispersing and grinding, a Ross double planetary mixer manufactured by Charles Ross and Son, Hauppauge, N.Y., or a two roll heated mill, which usually requires no particulate media. Useful particulate media include materials like a spherical cylinder of stainless steel, carbon steel, alumina, ceramic, zirconia, silica and sillimanite. Carbon steel particulate media are particularly useful when colorants other than black are used. A typical diameter range for the particulate media is in the range of 0.04 to 0.5 inch (approximately 1.0 to approximately 13 millimeters).

Sufficient nonpolar liquid is added to provide a dispersion of from about 30 to about 60, and more specifically, from about 35 to about 45 percent solids. This mixture is then subjected to elevated temperatures during the initial mixing procedure to plasticize and soften the resin. Thereafter, the mixture is sufficiently heated to provide a uniform dispersion of all the solid materials of, for example, colorant, cyclodextrin or aluminum complex charge acceptance component, and resin. The temperature should not be high where degradation of the nonpolar liquid or decomposition of the resin or colorant occurs. Accordingly, the mixture in embodiments is heated to a temperature of from about 50° C. to about 110° C., and preferably from about 50° C. to about 80° C. The mixture may be ground in a heated ball mill or heated attritor at this temperature for about 15 minutes to 5 hours, and preferably about 60 to about 180 minutes.

After grinding at the above temperatures, an additional amount of nonpolar liquid may be added to the resulting dispersion. The amount of nonpolar liquid added should be sufficient in embodiments preferably to decrease the total solids concentration of the dispersion to about 10 to about 30 percent by weight.

The dispersion is then cooled, for example, to about 10° C. to about 30° C., and preferably to about 15° C. to about 25° C., while mixing is continued until the resin admixture solidifies or hardens. Upon cooling, the resin admixture precipitates out of the dispersant liquid. Cooling is accomplished by methods, such as the use of a cooling fluid like water, glycols such as ethylene glycol, in a jacket surrounding the mixing vessel. More specifically, cooling can be accomplished, for example, in the same vessel, such as an attritor, while simultaneously grinding with particulate media to prevent the formation of a gel or solid mass; without stirring to form a gel or solid mass, followed by shredding the gel or solid mass and grinding by means of particulate media; or with stirring to form a viscous mixture and grinding by means of particulate media. The resin precipitate is cold ground for about 1 to about 36 hours, and preferably from about 2 to about 4 hours. Additional liquid may be added during the preparation of the liquid developer to facilitate grinding or to dilute the developer to the appropriate percent solids needed for developing. Other processes of preparation are generally illustrated in U.S. Pat. Nos. 4,760,009; 5,017,451; 4,923,778; 4,783,389, the disclosures of which are totally incorporated herein by reference.

As illustrated herein, the developers or inks of the present invention can be selected for RCP imaging and printing methods wherein, for example, there can be selected an imaging apparatus, wherein an electrostatic latent image, including image and nonimage areas, is formed in a layer of marking or liquid developer material, and further wherein the latent image can be developed by selectively separating portions of the latent image bearing layer of the marking material such that the image areas reside on a first surface and the nonimage areas reside on a second surface. In embodiments, the present invention relates to an image development apparatus, comprising a system for generating a first electrostatic latent image on an imaging member, wherein the electrostatic latent image includes image and nonimage areas having distinguishable charge potentials, and a system for generating a second electrostatic latent image on a layer of marking materials situated adjacent the first electrostatic latent image on the imaging member, wherein the second electrostatic latent image includes image and nonimage areas having distinguishable charge potentials of a polarity opposite to the charge potentials of the charged image and nonimage areas in the first electrostatic latent image. Marking material refers, for example, to the solids of the liquid developer or the liquid developer itself.

Embodiments of the invention will be illustrated in the following nonlimiting Examples, it being understood that these Examples are intended to be illustrative only, and that the invention is not intended to be limited to is the materials, conditions, process parameters and the like recited. The toner particles or solids in the liquid developer can range in diameter size of from about 0.1 to about 3.0 micrometers, and the preferred particle size range is about 0.5 to about 1.5 micrometers. Particle size, when measured, was determined by a Horiba CAPA-700 centrifugal automatic particle analyzer manufactured by Horiba Instruments, Inc., Irvine, Calif. Comparative Examples and data are also provided.

Charging Current Test

Charging Current Test for Embodiments Using Cyclodextrins as Charge Acceptance Agents An experimental setup for accomplishing a charging current test is illustrated in FIG. 1. A thin (5 to 25 micrometers) liquid toner layer 5 is prepared on a flat conductive plate 6. The plate is grounded through a meter 7. The charging wire of the scorotron is represented by 1, the scorotron grid by 3, ions by 4, ground by 8, and electrostatic voltmeter by 10 with DC representing direct current. A charging device, such as a scorotron 2, is placed above the plate. With no toner layer on the plate (bare plate), the current that passes through the plate to the ground is a constant ($I_b$) during charging. Assuming a toner layer is a pure insulator, the current passing from the plate to the ground is zero during charging. By monitoring the current that passes through the plate to ground, the toner charge capture or acceptance ability can be measured. The closer the steady state current is to zero, the more charge the toner layer has captured or accepted. The closer the steady state current is to the bare plate current $I_b$, the less charge the toner layer has captured or accepted. The faster the current reaches its steady state, the higher is the toner charge capturing or accepting efficiency. One way to analyze the experimental data is to calculate the absolute current difference of a toner layer on the plate and a bare plate. The larger the current difference, the more charge the toner layer has captured or accepted.

Charging Voltage Test

Charging Voltage Test for Embodiments Using Cyclodextrins as Charge Acceptance Agents An experimental setup for a charging voltage test is similar to the one illustrated in FIG. 1 except that a meter 7 is not required. A thin (5 to 25 micrometers) liquid toner layer is prepared on a flat conductive plate. A scorotron is placed above the sample plate. When the scorotron is turned off, the charged toner layer on the plate is instantly moved to an immediately adjacent location underneath the electrostatic voltmeter (ESV) in order to measure the surface voltage. The ESV 10 is located about 1 to about 2 millimeters above the charged toner layer. A typical test involves first charging the toner layer with a scorotron for 0.5 second, and then monitoring the surface voltage decay as a function of time for two minutes. This is accomplished for both positively and negatively charged toner layers.

Examples

Control 1 in Tables 1 and 2=40 Percent of PV FAST BLUE®; 5 Percent Cyclodextrin; Alohas Charge Director Concentration=1 mg/g Solids One hundred forty-eight point five (148.5) grams of ELVAX200W® (a copolymer of ethylene and vinyl acetate with a melt index at 190° C. of 2,500, available from E.I. DuPont de Nemours & Company, Wilmington, Del.), 108.0 grams of the cyan pigment (PV FAST BLUE B2GA® obtained from Clarient), 13.5 grams of beta cyclodextrin also known as cycloheptaamylose and cyclomaltoheptaose obtained from Cerestar, Inc.) and 405 grams of ISOPAR-M® (Exxon Corporation) were added to a Union Process 1S attritor (Union Process Company, Akron, Ohio) charged with 0.1857 inch (4.76 millimeters) diameter carbon steel balls. The mixture was milled in the attritor which was heated with running steam through the attritor jacket at 56° C. to 115° C. for 2 hours. 675 Grams of ISOPAR-M® were added to the attritor, and cooled to 23° C. by running water through the attritor jacket, and the contents of the attritor were ground for 4 hours. Additional ISOPAR-M®, about 300 grams, was added and the mixture was separated from the steel balls.

To a one-hundred gram sample of the above toner discharged from attritor (11.549 percent solids) was added 0.385 gram of Alohas charge director (3 weight percent in ISOPAR-M®) to provide a charge director level of 1.0 milligram of charge director per gram of toner solids.

Alohas is hydroxy bis(3,5-di-tertiary butyl salicylic) aluminate monohydrate, reference for example U.S. Pat. Nos. 5,366,840 and 5,324,613, the disclosures of which are totally incorporated herein by reference.

The resulting chemical charged liquid developer was comprised of toner solids containing 55 percent resin, 40 percent pigment, 5 percent cyclodextrin charge control additive (percent by weight throughout based on the total toner solids), ISOPAR-M®, and Alohas charge director, 3 weight percent, which chemically charges the toner positively.

Control 2 in Tables 1 and 2=40 Percent of PV FAST BLUE®; 5 Percent Cyclodextrin; Alohas Charge Director Concentration=2 mg/g solids One hundred forty-eight point five (148.5) grams of ELVAX200W® (a copolymer of ethylene and vinyl acetate with a melt index at 190° C. of 2,500, available from E.I. DuPont de Nemours & Company, Wilmington, Del.), 108.0 grams of the cyan pigment (PV FAST BLUE B2GA® obtained from Clarient), 13.5 grams of the above beta cyclodextrin (cyclodextrin obtained by Cerestar, Inc.) and 405 grams of ISOPAR-M® (Exxon Corporation) were added to a Union Process 1S attritor (Union Process Company, Akron, Ohio) charged with 0.1857 inch (4.76 millimeters) diameter carbon steel balls. The resulting mixture was milled in the attritor which was heated with running steam through the attritor jacket at 56° C. to 115° C. for 2 hours. 675 Grams of ISOPAR-M® were added to the attritor, and cooled to 23° C. by running water through the attritor jacket, and the contents of the attritor were ground for 4 hours. Additional ISOPAR-M®, about 300 grams, was added and the mixture was separated from the steel balls.

To a one hundred gram sample of the mixture (11.549 percent solids) was added 0.770 gram of Alohas charge director (3 weight percent in ISOPAR-M®) to provide a charge director level of 2.0 milligrams of charge director per gram of toner solids.

Alohas is an abbreviated name for hydroxy bis(3,5-di-tertiary butyl salicylic) aluminate monohydrate, reference for example U.S. Pat. Nos. 5,366,840 and 5,324,613, the disclosures of which are totally incorporated herein by reference.

The resulting liquid developer was comprised of toner solids containing 55 percent resin, 40 percent pigment, 5 percent cyclodextrin charge control additive (based on the total toner solids), ISOPAR-M®, and Alohas charge director which chemically charges the toner positively. This developer is a chemically charged liquid developer composition.

Example 1 in Tables 1 and 2=40 Percent of PV FAST BLUE®; 5 Percent Cyclodextrin; No Alohas Added One hundred forty-eight point five (148.5) grams of ELVAX200W® (a copolymer of ethylene and vinyl acetate with a melt index at 190° C. of 2,500, available from E.I. DuPont de Nemours & Company, Wilmington, Del.), 108.0 grams of the cyan pigment (PV FAST BLUE B2GA® obtained from Clarient), 13.5 grams of the above beta cyclodextrin (Cyclodextrin obtained by Cerestar, Inc.) and 405 grams of ISOPAR-M® (Exxon Corporation) were added to a Union Process 1S attritor (Union Process Company, Akron, Ohio) charged with 0.1857 inch (4.76 millimeters) diameter carbon steel balls. The resulting mixture was milled in the attritor which was heated with running steam through the attritor jacket at 56° C. to 115° C. for 2 hours. 675 Grams of ISOPAR-M® were added to the attritor, and cooled to 23° C. by running water through the attritor jacket, and the contents of the attritor were ground for 4 hours. Additional ISOPAR-M®, about 300 grams, was added and the mixture was separated from the steel balls.

The liquid developer was used as is from attritor (11.549 percent solids).

The resulting liquid developer was comprised of toner solids containing 55 percent resin, 40 percent pigment, 5 percent cyclodextrin charge acceptance additive (percent by weight throughout based on the total toner solids), and ISOPAR-M®. This developer is considered an ion-charged liquid developer composition.

Charging Current Test Results

Tables 1 and 2 contain the charging current test results. Table 1 lists the raw data readings and Table 2 lists the after process data. The following discussion and numbers refer to Table 2. The charging current test experimental setup is illustrated in FIG. 1. When Alohas charge director is not added to the liquid toner formulation, the charging current difference with a bare plate in Example 1 (Table 2) indicates that after first charging the toner layer positive and then reversing to negative, the positive current difference is 0.15 $\mu$A and the reverse negative current difference is 0.14 $\mu$A. This result indicates that when using cyclodextrin as the charge acceptance agent without Alohas charge director present the charging polarity can be reversed to about the same levels. In controls 1 and 2 of Table 2, in which 1 milligram and 2 milligrams of Alohas charge director per gram of toner solids were used, respectively, reversing the charging polarity from positive to negative provided small current difference values (0.04 and 0.05 $\mu$A) which indicates that the toner layer resisted being charged to a negative polarity. It is believed that the soluble Alohas charge director captures negative charge, and that the captured negative charge immediately migrates to ground in the liquid phase leaving very little negative charge remaining on the toner particles in the solid phase.

When Alohas charge director is not added to the liquid toner formulation, the charging current difference with a bare plate in Example 1 (Table 2) indicates that after first charging the toner layer negative and then reversing to positive, the negative current difference is 0.18 $\mu$A and the reverse positive current difference is 0.15 $\mu$A. This result indicates that when using cyclodextrin as the charge acceptance agent without Alohas charge director present, the charging polarity can be easily reversed to about the same levels. In controls 1 and 2 of Table 2, in which 1 milligram and 2 milligrams of Alohas charge director per gram of toner solids were used respectively, reversing the charging polarity from negative to positive again provided small current difference values (0.04 and 0.05 $\mu$A) which indicates that the toner layer resisted being charged to a positive polarity.

TABLE 1

| | Ink Composition | | | | | Charging Current Test Results | | | |
|---|---|---|---|---|---|---|---|---|---|
| | | | | | | Positive then Negative | | Negative then Positive | |
| | Solid Phase | | | Liquid Phase | | current of positive charging at 1 second* | current of negative charging at 1 second** | current of negative charging at 1 second* | current of positive charging at 1 second** |
| | Resin | Pigment | Charge acceptor | Carrier fluid | Charge director | | | | |
| Control 1 (A typical LID ink) | 55% Elvax 200 W | 40% PVFB | 5% cyclo-dextrin | Isopar M | 1:1 Alohas | 0.35 | −0.56 | −0.55 | 0.45 |
| Control 2 (A typical LID ink) | 55% Elvax 200 W | 40% PVFB | 5% cyclo-dextrin | Isopar M | 2:1 Alohas | 0.35 | −0.55 | −0.56 | 0.45 |
| Example 1 | 55% Elvax 200 W | 40% PVFB | 5% cyclo-dextrin | Isopar M | No | 0.35 | −0.46 | −0.42 | 0.35 |

*The positive current that passed through a bare plate was 0.5 $\mu$A
**The negative current that passed through a bare plate was −0.6 $\mu$A

TABLE 2

| | Ink Composition | | | | | Charging Current Test Results | | | |
|---|---|---|---|---|---|---|---|---|---|
| | | | | | | Positive then Negative | | Negative then Positive | |
| | Solid Phase | | | Liquid Phase | | current difference* of positive charging at 1 second | current difference* of negative charging at 1 second | current difference* of negative charging at 1 second | current difference* of positive charging at 1 second |
| | Resin | Pigment | Charge acceptor | Carrier fluid | Charge director | | | | |
| Control 1 (A typical LID ink) | 55% Elvax 200 W | 40% PVFB | 5% cyclo-dextrin | Isopar M | 1:1 Alohas | 0.15 | 0.04 | 0.05 | 0.05 |
| Control 2 (A typical LID ink) | 55% Elvax 200 W | 40% PVFB | 5% cyclo-dextrin | Isopar M | 2:1 Alohas | 0.15 | 0.05 | 0.04 | 0.05 |
| Example 1 | 55% Elvax 200 W | 40% PVFB | 5% cyclo-dextrin | Isopar M | No | 0.15 | 0.14 | 0.18 | 0.15 |

*current difference = $II_t - I_bI$, where $I_t$ is the current that passes through the plate 6 (to ground) on which a toner layer is located; $I_b$ is the current that passes through the bare plate to ground.

Control in Table 3=100 Percent of DuPont ELVAX 200W®; No Charge Acceptance Agent Two hundred and seventy (270.0) grams of ELVAX 200W® (a copolymer of ethylene and vinyl acetate resin with a melt index at 190° C. of 2,500, available from E.I. DuPont de Nemours & Company, Wilmington, Del.), and 405 grams of ISOPAR-L® (Exxon Corporation) were added to a Union Process 1S attritor (Union Process Company, Akron, Ohio) charged with 0.1857 inch (4.76 millimeters) diameter carbon steel balls. The mixture was milled in the attritor which was heated with running steam through the attritor jacket at 56° C. to 115° C. for 2 hours. 675 Grams of ISOPAR-G® were added to the attritor, and cooled to 23° C. by running water through the attritor jacket, and the contents of the attritor were ground for 2 hours. Additional ISOPAR-G®, about 900 grams, was added and the mixture was separated from the steel balls.

The liquid developer, which was used as is from the attritor, was comprised of 11.779 percent toner solids (100 percent resin), and 88.221 percent ISOPAR®.

Example 1 in Table 3=99 Percent of DuPont ELVAX 200W®; 1 Percent Tertiary Amine β-cyclodextrin Two hundred and sixty-seven point three (267.3) grams of ELVAX 200W® (a copolymer of ethylene and vinyl acetate with a melt index at 190° C. of 2,500, available from E.I. DuPont de Nemours & Company, Wilmington, Del.), 2.7 grams of tertiary amine β-cyclodextrin (available from Cerestar, Inc., Hammond, Ind.) and 405 grams of ISOPAR-L® (Exxon Corporation) were added to a Union Process 1S attritor (Union Process Company, Akron, Ohio) charged with 0.1857 inch (4.76 millimeters) diameter carbon steel balls. The mixture was milled in the attritor which was heated with running steam through the attritor jacket at 56° C. to 115° C. for 2 hours. 675 Grams of ISOPAR-G® were added to the attritor, and cooled to 23° C. by running water through the attritor jacket, and the contents of the attritor were ground for 2 hours. Additional ISOPAR-G®, about 900 grams, was added and the mixture was separated from the steel balls.

Liquid developer which was used as is from the attritor (11.701 percent solids based on the total of the liquid developer) was comprised of toner solids, which contains 99 percent of the above ELVAX® resin and charge acceptor of 1 percent tertiary amine β-cyclodextrin (based on total toner solids), and 88.299 percent ISOPAR®.

Example 2 in Table 3=95 Percent of DuPont ELVAX 200W®; 5 Percent Tertiary Amine β-cyclodextrin Two hundred and fifty-six (256.0) grams of ELVAX 200W® (a copolymer of ethylene and vinyl acetate with a melt index at 190° C. of 2,500, available from E.I. DuPont de Nemours & Company, Wilmington, Del.), 13.5 grams of tertiary amine β-cyclodextrin (available from Cerestar, Inc., Hammond, Ind.) and 405 grams of ISOPAR-L® (Exxon Corporation) were added to a Union Process 1S attritor (Union Process Company, Akron, Ohio) charged with 0.1857 inch (4.76 millimeters) diameter carbon steel balls. The mixture resulting was milled in the attritor which was heated with running steam through the attritor jacket at 56° C. to 115° C. for 2 hours. 675 Grams of ISOPAR-G® were added to the attritor, and cooled to 23° C. by running water through the attritor jacket, and the contents of the attritor were ground for 2 hours. Additional ISOPAR-G®, about 900 grams, was added and the mixture was separated from the steel balls.

Liquid developer, which was used as is from the attritor, (11.463 percent solids) was comprised of 11.463 percent toner solids containing 95 percent resin and 5 percent cyclodextrin charge acceptance additive based on total toner solids, and 88.537 percent ISOPAR-M®.

Charging Voltage Test Results

To better understand the effect of the charge acceptor on RCP ink charging, the toner layer surface-charging voltage test illustrated herein can be selected.

TABLE 3

| | Ink Composition | | | | | Test Results | | | |
|---|---|---|---|---|---|---|---|---|---|
| | | | | | | Positive | | Negative | |
| | Solid Phase | | | Liquid Phase | | Initial | Surface Voltage | Initial | Surface Voltage |
| | Resin | Pigment | Charge acceptor | Carrier fluid | Charge director | surface voltage | after 5 seconds | surface voltage | after 5 seconds |
| Control | 100% Elvax 200 W | No | No | Isopar M | No | 10 | 2 | −11 | −10 |
| Example 1 | 99% Elvax 200 W | No | 1% cyclo-dextrin | Isopar M | No | 12 | 8 | −16 | −15 |
| Example 2 | 95% Elvax 200 W | No | 5% cyclo-dextrin | Isopar M | No | 22 | 15 | −22 | −18 |

Ink (toner) layers, with thickness of 15 μm, were generated by draw bar coating. Scorotrons were used as the charging and recharging devices.

The positive and negative toner layer charge-capturing propensity can be measured by several techniques. One of the most frequently used techniques involves first charging the toner layer with a scorotron for a fixed time, e.g. 2 seconds, and then monitoring the surface voltage decay as a function of time when charging is avoided or turned off. This is accomplished for both positively and negatively charged toner layers.

The data in the control of Table 3 indicates that the ink layer with no charge acceptor captured or accepted negative charge equivalent to a surface voltage of −11 volts and maintained −10 volts thereof for 5 seconds. However, the same ink layer, when charged positively, captured or accepted +10 volts initially, but then the voltage of this control ink layer decayed rapidly to 2 volts in 5 seconds.

The data in Example 1 of Table 3, wherein 1 percent tertiary amine cyclodextrin was used as the charge acceptance agent, indicates that the ink layer, when charged negatively, captured or accepted negative charge equivalent to a surface voltage of −16 volts and maintained −15 volts thereof for 5 seconds. However, when charged positively, the same ink layer captured or accepted +12 volts and decayed slowly to 8 volts in 5 seconds. When charged negatively, the ink layer containing the 1 percent cyclodextrin charge acceptance agent improved (versus the control without cyclodextrin) in negative charging level from −11 volts to −16 volts (145 percent improvement). Comparing the decay for the 5 second negative surface voltage in Example 1 versus the Control indicated that in Example 1 the 5 second negative surface voltage was −15 volts (50 percent improvement) whereas in the Control the 5 second negative surface voltage was only −10 volts. When charged positively, the ink layer containing the 1 percent cyclodextrin charge acceptance agent improved in positive charging level from +10 volts to +12 volts (120 percent improvement). Comparing the decay for the 5 second positive surface voltage in Example 1 versus the Control indicated that in Example 1 the 5 second positive surface voltage was +8 volts (400 percent improvement) whereas in the Control the 5 second positive surface voltage was only +2 volts.

The data in Example 2 of Table 3, wherein 5 percent tertiary amine cyclodextrin was used as the charge acceptance agent, indicates that the ink layer, when charged negatively, captured or accepted negative charge equivalent to a surface voltage of −22 volts and maintained −18 volts thereof for 5 seconds. However, when charged positively, the same ink layer captured or accepted +22 volts and decayed slowly to 15 volts in 5 seconds. When charged negatively, the ink layer containing the 5 percent cyclodextrin charge acceptance agent improved (versus the control without cyclodextrin) in negative charging level from −11 volts to −22 volts (200 percent improvement). Comparing the decay for the 5 second negative surface voltage in Example 2 versus the Control indicated that in Example 2 the 5 second negative surface voltage was −18 volts (180 percent improvement) whereas in the Control the 5 second negative surface voltage was only −10 volts. When charged positively, the ink layer containing the 5 percent cyclodextrin charge acceptance agent improved in positive charging level from +10 volts (control without cyclodextrin) to +22 volts (220 percent improvement). Comparing the decay for the 5 second positive surface voltage in Example 2 versus the Control indicated that in Example 2 the 5 second positive surface voltage was +15 volts (750 percent improvement) whereas in the Control the 5 second positive surface voltage was only +2 volts.

The following RCP print tests were used for the liquid developers containing, for example, aluminum carboxylate complexes (such as Alohas) as charge acceptance agents:

RCP Bench Print Test

Four Options for Using the Bench Print Test

Reverse Charge Printing (RCP) development is initiated with a uniform uncharged toner layer. A first charging device charges toner to a first polarity, then a second charging device reverses the toner charge to a second polarity in an imagewise fashion. A biased Image Bearer (IB) subsequently separates the image from the background corresponding to the charge pattern in the toner layer. Thus, the toner image is formed on the IB and is ready to be transferred to final substrates. Since it is preferred that the first polarity of toner charge be the same as that of the P/R (photoreceptor imaging member) polarity, if a P/R is used, the toner layer may be first charged to a positive polarity when, for example, amorphous silicon is used as the photoreceptor and first charged to a negative polarity when an organic layered photoreceptor, reference U.S. Pat. No. 4,265,990, the disclosure of which is totally incorporated herein by reference, is used. The IB bias can be either the same as or opposite to that of the recharging device depending on the latent image polarity. Table 4 summarizes the four process options in RCP development. An objective of the bench print test for RCP is to identify the optimized process parameters for each ink by acquiring four development curves for all the process options. From each print test, the expemost desired outputs are minimum photoreceptor charge contrast, maximum ROD (ROD >1.3) in solid area minimum ROD (background ROD <0.15) in background area, and excellent solid area image quality. [Delta E=the square root of sum of squares of L*, a*, and b* less than 2 for both microscopic and macroscopic uniformity].

TABLE 4

RCP Print Test Options

| Development Options | Charge Entire Toner Layer to a First Polarity | Charge Selected Area of Toner Layer to a Second Polarity | IB Bias Polarity |
|---|---|---|---|
| (−,+,−) | − | + | − |
| (−,+,+) | − | + | + |
| (+,−,+) | + | − | + |
| (+,−,−) | + | − | − |

In the first print test option in Table 4 above, the entire toner layer on the dielectric surface is first charged negative, and then only the imaged area charge is reversed to positive, and finally the image bearing member (IB) biased to a negative polarity transfers the imaged area to itself. In the second print test option in Table 4, the entire toner layer on the dielectric surface is first charged negative, and then only the background area charge is reversed to positive, and finally the image bearing member (IB) biased to a positive polarity transfers the imaged area to itself. In the third print test option in Table 4, the entire toner layer on the dielectric surface is first charged positive, and then only the imaged area charge is reversed to negative, and finally the image bearing member (IB) biased to a positive polarity transfers the imaged area to itself. The first and third options are the same except that the charge polarities are reversed at each stage. In the fourth print test option in Table 4, the entire toner layer on the dielectric surface is first charged positive, and then only the background area charge is reversed to negative, and finally the image bearing member (IB) biased to a negative polarity transfers the imaged area to itself. The second and fourth options are the same except that the charge polarities are reversed at each stage.

Figure 2:
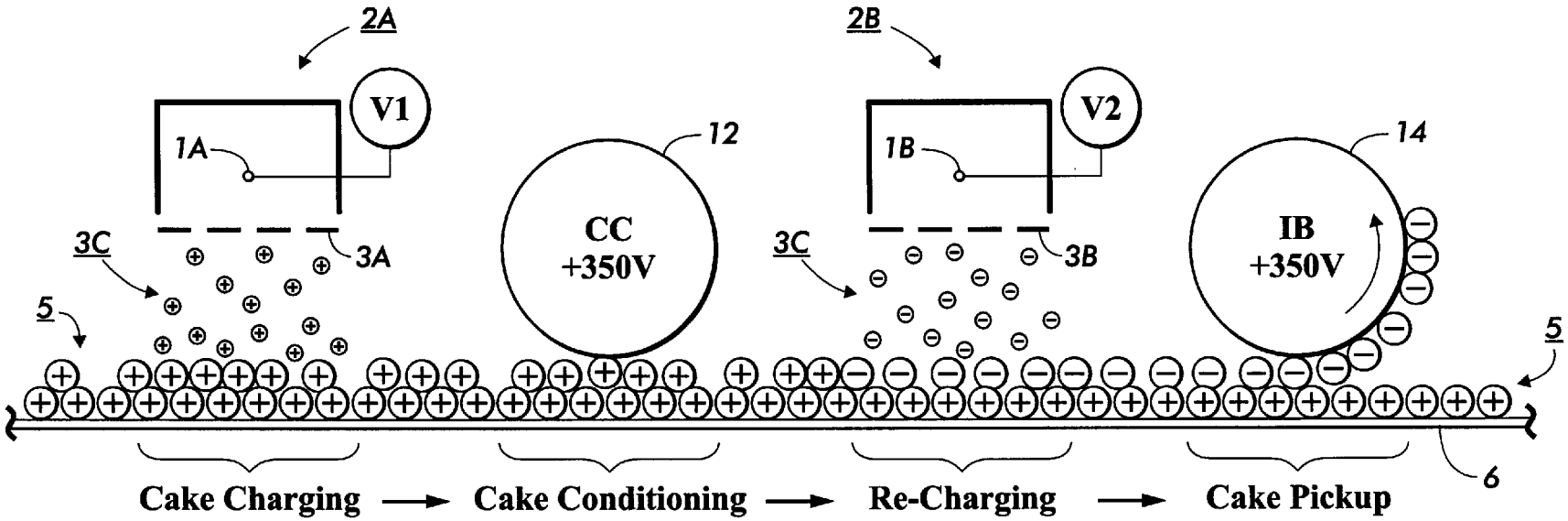
FIG. 2 illustrates a reverse charge printing (RCP) process and apparatus.

In FIG. 2, 5 represents positively charged toner particles on a photoreceptor surface; or photoreceptor or imaging element dielectric surface 6; 3C represents ions from a corona source; 2A is a charging scorotron; 12 is a biased conditioning roll which functions to remove some liquid from the toner layer without changing charge polarity or charge level; 2B is a recharging scorotron; 14 is a biased image bearer roll; 3A and 3B represent the scorotron grid;

1A and 1B represent charging wires of the scorotron; V1 is equal to 300 volts; cake charging is accomplished with N-mep+300V in the dark; cake conditioning is accomplished at 0V light on; cake recharging V2 is accomplished in the dark, and cake pickup is accomplished at 0V light on. N-mep is negatively charged migration electrophotographic charged positively, reference U.S. Pat. Nos. 4,536,458 and 4,536,457, the disclosures of which are totally incorporated herein by reference; 0V represents light on that is zero volts (V) when exposed to light; V2 in dark refers to being recharged to a voltage V2, which voltage is the same as the scorotron grid voltage; with the cake charging the toner layer contains about 5 to 15 weight percent solids coated on the N-mep, and wherein both are charged by the scorotron to 300 volts (V); cake conditioning refers to increasing the solids content of the positively charged toner layer from about 5 to about 15 percent to about 20 to about 22 percent, and wherein there is selected for this conditioning a positively charged squegee roll or image conditioning roll; re-charging refers to the imagewise recharging of the toner layer, which recharging is accomplished with a second scorotron 2B, and wherein the polarity is negative; cake and cake pickup refers to the cake comprised of nonpolar liquid or carrier fluid, toner particles or solids of resin, charge acceptance component and colorant, 20 to 22 percent solids, and wherein the cake is picked up or developed by the positively charged IB roll or image bearer roll 14.

In the experiments, the imaging member 6 (P/R) had permanent image patterns thereupon. After the P/R was charged in the dark, the imaged area was discharged under room light exposure while the background area held charge. In this RCP bench experiment, a draw bar coating device was used to coat a thin uniform toner layer onto the N-mep photoreceptor using an ink containing 10 to 15 weight percent solids. Two scorotrons were used to charge and recharge the toner layer and a biased metal roll was wrapped with Rexham 6262 dielectric paper with the rough side contacting the toner layer to function as the cake conditioning device (CC). Another biased metal roll, wrapped with the smooth side of the Rexham 6262 paper, contacted the toner layer to function as the image bearer (IB). FIG. 2 illustrates the experimental steps for (+,–,+) RCP development. Charging and recharging of the N-mep photoreceptor was accomplished in the dark in order to hold the same amount of charge in every experiment. The cake conditioning and cake transfer to the image bearer were operated with a light on to permit the N-mep photoreceptor to fully discharge in order to create a strong electric field in the process nip without air breakdown, and to maintain the same experimental condition for every data point. After the toner layer was charged to a positive polarity, the N-mep photoreceptor was discharged by light and the cake conditioning roll was biased to the same polarity as that of the toner charging device. The cake conditioning roll was applied to the positively charged toner layer surface to squeeze out extra carrier fluid and to compress the toner cake to a higher solids content. The recharging step was also operated in the dark. The scorotron screen bias V2 and the electrical properties of the N-mep photoreceptor, which control the amount of negative charge delivered to the toner layer, together with the toner material properties, determine the toner charge reversal efficiency. In these experiments, the development curve was defined as the ROD of the fused toner on the IB as a function of V2. The bias on the IB 14 was set at 350V.

Examples for Alohas

Control 1=40 Percent of Rhodamine Y Magenta; 0.7 Percent Alohas Bound to Toner Resin as Charge Control Agent; Alohas as Charge Director in Liquid Phase (0.5 mg Alohas CD Per Gram of Toner Solids)

One hundred sixty point four (160.4) grams of NUCREL RX-76® (a copolymer of ethylene and methacrylic acid with a melt index of about 800, available from E.I. DuPont de Nemours & Company, Wilmington, Del.), 2.0 grams of Alohas Powder and 405 grams of ISOPAR-M® (Exxon Corporation) were added to a Union Process 1S attritor (Union Process Company, Akron, Ohio) charged with 0.1857 inch (4.76 millimeters) diameter carbon steel balls. The mixture was milled in the attritor, which was heated with running steam through the attritor jacket to 80° C. to 115° C. for 2.0 hours. Next, 107.6 grams of the magenta pigment (Sun Rhodamine Y 18:3 obtained from Sun Chemicals) was added to the attritor. The mixture was milled in the attritor, which was maintained at 80° C. to 115° C. for 2 hours with running steam through the attritor jacket. 675 Grams of ISOPAR-M® were added to the attritor at the conclusion of 4 hours, and cooled to 23° C. by running water through the attritor jacket, and the contents of the attritor were ground for an additional 4 hours. Additional ISOPAR-M®, about (600 grams), was added and the mixture was separated from the steel balls.

To a one hundred gram sample of the mixture (11.841 percent solids) was added 0.197 gram of Alohas charge director (3 weight percent in ISOPAR-M®) to provide a charge director level of 0.5 milligram of charge director per gram of toner solids.

The liquid developer solids contain 40 percent by weight of Rhodamine Y magenta pigment; 0.7 percent Alohas as a charge control agent bound to the toner resin, and 59.3 percent NUCREL RX-76® toner resin. The solids level was 11.841 percent and the ISOPAR M® carrier liquid and soluble Alohas charge director comprised 88.159 percent of this liquid developer.

Alohas is hydroxy bis(3,5-di-tertiary butyl salicylic) aluminate monohydrate, reference for example U.S. Pat. Nos. 5,366,840 and 5,324,613, the disclosures of which are totally incorporated herein by reference.

Control 2=40 Percent of Rhodamine Y Magenta Pigment; 0.7 Percent Alohas Bound to Toner Resin as Charge Control Agent: HBr Quat 93K as Charge Director in Liquid Phase (5.0 mg HBr Quat 93K CD Per Gram of Toner Solids)

One hundred sixty point four (160.4) grams of NUCREL RX-76® (a copolymer of ethylene and methacrylic acid with a melt index of about 800, available from E.I. DuPont de Nemours & Company, Wilmington, Del.), 2.0 grams of Alohas Powder and 405 grams of ISOPAR-M® (Exxon Corporation) were added to a Union Process 1S attritor (Union Process Company, Akron, Ohio) charged with 0.1857 inch (4.76 millimeters) diameter carbon steel balls. The mixture was milled in the attritor, which was heated with running steam through the attritor jacket to 80° C. to 115° C. for 2.0 hours. Next, 107.6 grams of the magenta pigment (Sun Rhodamine Y 18:3 obtained from Sun Chemicals) was added to the attritor. The mixture was milled in the attritor, which was maintained at 80° C. to 115° C. for 2 hours with running steam through the attritor jacket. 675 Grams of ISOPAR-M® were added to the attritor at the conclusion of 4 hours, and cooled to 23° C. by running water through the attritor jacket, and the contents of the attritor were ground for an additional 4 hours. Additional ISOPAR-M®, about 600 grams, was added, and the mixture was separated from the steel balls.

To a 100 gram sample of the mixture (11.841 percent solids) were added 1.184 grams of HBr Quat 93K (93,000 $M_w$) charge director (5 weight percent in ISOPAR-M®) to provide a charge director level of 5.0 milligrams of charge director per gram of toner solids.

The liquid developer solids contain 40 percent by weight of Rhodamine Y magenta pigment, 0.7 percent Alohas as charge control agent bound to the toner resin, and 59.3 percent NUCREL RX-76® toner resin. The solids level is 11.841 percent and the ISOPAR-M® carrier liquid and soluble 93K HBr quat charge director comprise 88.159 percent of this liquid developer.

Alohas is an abbreviation for hydroxy bis(3,5-di-tertiary butyl salicylic) aluminate monohydrate, reference for example U.S. Pat. Nos. 5,366,840 and 5,324,613, the disclosures of which are totally incorporated herein by reference.

HBr Quat 93K is AB diblock copolymer of poly(2-ethylhexyl methacrylate (A Block)-co-N,N-dimethylamino-N-ethyl methacrylate ammonium bromide (B Block)) with an $M_w$. of 93K, reference for example U.S. Pat. No. 5,441,841, the disclosure of which are totally incorporated herein by reference.

Example 1=40 Percent of Rhodamine Y Magenta Pigment; 0.7 Percent Alohas Charge Acceptance Agent Bound to Toner Resin One hundred sixty point four (160.4) grams of NUCREL RX-76® (a copolymer of ethylene and methacrylic acid with a melt index of about 800, available from E.I. DuPont de Nemours & Company, Wilmington, Del.), 2.0 grams of Alohas powder and 405 grams of ISOPAR-M® (Exxon Corporation) were added to a Union Process 1S attritor (Union Process Company, Akron, Ohio) charged with 0.1857 inch (4.76 millimeters) diameter carbon steel balls. The mixture was milled in the attritor, which was heated with running steam through the attritor jacket to 80° C. to 115° C. for 2.0 hours. Next, 107.6 grams of the magenta pigment (Sun Rhodamine Y 18:3 obtained from Sun Chemicals) were added to the attritor. The mixture resulting was milled in the attritor, which was maintained at 80° C. to 115° C. for 2 hours with running steam through the attritor jacket. 675 Grams of ISOPAR-M® were added to the attritor at the conclusion of 4 hours, and cooled to 23° C. by running water through the attritor jacket, and the contents of the attritor were ground for an additional 4 hours. Additional ISOPAR-M®, about 600 grams, was added, and the mixture was separated from the steel balls.

The liquid developer solids contain 40 percent by weight of Rhodamine Y magenta pigment, 0.7 percent Alohas as a charge acceptance agent bound to the toner resin, and 59.3 percent NUCREL RX-76® toner resin. The solids level was 11.841 percent and the ISOPAR-M® level was 88.159 percent of this liquid developer.

Alohas is hydroxy bis(3,5-di-tertiary butyl salicylic) aluminate monohydrate, reference for example U.S. Pat. Nos. 5,366,840 and 5,324,613, the disclosures of which are totally incorporated herein by reference.

Example 2=25 Percent of Rhodamine Y Magenta Pigment; No Charge Acceptance Agent

Two hundred and two point five (202.5) grams of NUCREL RX-76® (a copolymer of ethylene and methacrylic acid with a melt index of 800, available from E.I. DuPont de Nemours & Company, Wilmington, Del.), 67.5 grams of the magenta pigment (Sun Rhodamine Y 18:3 obtained from Sun Chemicals) and 405 grams of ISOPAR-M® (Exxon Corporation) were added to a Union Process 1 S attritor (Union Process Company, Akron, Ohio) charged with 0.1857 inch (4.76 millimeters) diameter carbon steel balls. The mixture was milled in the attritor which was heated with running steam through the attritor jacket at 80° C. to 115° C. for 2 hours. 675 Grams of ISOPAR-M® were added to the attritor at the conclusion of 2 hours, and cooled to 23° C. by running water through the attritor jacket, and the contents of the attritor were ground for an additional 4 hours. Additional ISOPAR-M®, about 600 grams, was added, and the mixture was separated from the steel balls.

The liquid developer solids contained 25 percent by weight of Rhodamine Y magenta pigment; and 75 percent NUCREL RX-76® toner resin. The solids level was 12.519 percent and the ISOPAR-M® level was 87.418 percent of this liquid developer.

Example 3=25 Percent of Rhodamine Y Magenta Pigment; 0.9 Percent Alohas Charge Acceptance Agent Bound to Toner Resin Two hundred point one (200.1) grams of NUCREL RX-76® (a copolymer of ethylene and methacrylic acid with a melt index of 800, available from E.I. DuPont de Nemours & Company, Wilmington, Del.), and 2.43 grams of Alohas powder and 405 grams of ISOPAR-M® (Exxon Corporation) were added to a Union Process 1S attritor (Union Process Company, Akron, Ohio) charged with 0.1857 inch (4.76 millimeters) diameter carbon steel balls. The mixture was milled in the attritor which was heated with running steam through the attritor jacket at 80° C. to 115° C. for 2 hours. Next, 67.5 grams of the magenta pigment (Sun Rhodamine Y 18:3 obtained from Sun Chemicals) were added to the attritor. 675 Grams of ISOPAR-M® were added to the attritor at the conclusion of 2 hours, and cooled to 23° C. by running water through the attritor jacket, and the contents of the attritor were ground for an additional 4 hours. Additional ISOPAR-M®, about 600 grams, was added, and the mixture was separated from the steel balls.

The liquid developer solids contained 25 percent by weight of Rhodamine Y magenta pigment; 0.9 percent Alohas as a charge acceptance agent bound to the toner resin and 74.1 percent NUCREL RX-76® toner resin. The solids level was 12.911 percent and the ISOPAR-M® level was 87.089 percent of this liquid developer.

Alohas is hydroxy bis(3,5-di-tertiary butyl salicylic) aluminate monohydrate, reference for example U.S. Pat. Nos. 5,366,840 and 5,324,613, the disclosures of which are totally incorporated herein by reference.

RCP Print Test Results

The printing test results for the Controls and Examples are listed in Table 5. Control 1 is a typical liquid ink composition wherein the charge director, Alohas, in the liquid phase charges toner particles positively. When Control 1 ink was used in the RCP development process, the positive toner charge polarity could not be reversed to a negative one, so that the Control 1 ink prints out images with very high background (requirement: background ROD <0.1) and much less image/background contrast (requirement: image/background ROD contrast >1.2). Control 2 is another typical liquid ink. With a high concentration of HBr Quat 93K charge director, the toner particles in the Control 2 ink acquire a higher negative charging level. The Control 2 ink prints high-density images (requirement: image ROD >1.2) in a traditional liquid immersion development process, however, in a RCP development process, the Control 2 ink prints background extensively (ROD=0.38, which is too large versus the required ROD <0.15). The high charge director concentration (5 milligrams of charge director per gram of toner solids) renders it more difficult to reverse toner polarity. The inability to reverse toner charge polarity results in low-efficiency toner cake reclaim following the development and charge erase steps. Example 1 (with Alohas as the charge acceptance agent) of the RCP ink composition indicated significant background improvement since, for example, without a charge director in the ink, the charge on the toner particles could be reversed.

TABLE 5

| | Ink Composition | | | | | Image Optical density Toner charged to negative then reversed to positve Print @−200 V | Background density Toner charged to negative then reversed to positive Clean @+200 V | Image Optical density Toner charged to positive then reversed to negative Print @+200 V | Background density Toner charged to positive then reversed to negative Clean @−200 V | Comment |
|---|---|---|---|---|---|---|---|---|---|---|
| | Solid Phase | | | Liquid Phase | | | | | | |
| | Resin | Pigment | additive in solid phase | Carrier fluid | Charge director | | | | | |
| Control 1 (A typical LID ink) | 59.3% RX-76 | 40% Rd Y | 0.7% Alohas | Isopar M | 0.5:1 Alohas | 1.45 | 0.09 | 1.44 | 0.30 | Difficult to reverse to negative |
| Control 2 (A typical LID ink) | 59.3% RX-76 | 40% Rd Y | 0.7% Alohas | Isopar M | 5:1 HBrQ93K | 1.36 | 0.36 | 1.34 | 0.08 | Difficult to reverse to positive |
| Example 1 | 59.3% RX-76 | 40% Rd Y | 0.7% Alohas | Isopar M | No | 1.40 | 0.07 | 1.46 | 0.06 | Reversible |
| Example 2 | 75% RX-76 | 25% Rd Y | No | Isopar M | No | 1.29 | 0.12 | 1.18* | 0.07 | Higher back-ground |
| Example 3 | 74.1% RX-76 | 25% Rd Y | 0.9% Alohas | Isopar M | No | 1.46 | 0.06 | 1.2* | 0.07 | High image ROD, dean back-ground |
| | | | | | | | | Print @+100 V | | |

Examples 2, as a RCP ink composition, indicated that without Alohas in the particle phase as charge acceptor, the image contrast was not as large as in Examples 1 and 3, and the background was not as clean. This results indicated that the Alohas Charge Acceptor (CA) enhanced the charge-accepting efficiency of the toner particles.

With further reference to Table 5 and to further understand the effect of the charge acceptor on RCP ink charging, further print tests were accomplished using the RCP process to develop toners of Example 2 (no charge acceptor) and Example 3 (0.9 percent charge acceptor). The results in Example 3 indicated that the RCP liquid developer or ink containing 0.9 percent resin-bound Alohas charge acceptor provided a much higher image density (image ROD >1.25) and cleaner background (background ROD <0.15) when the toner layer was first charged negatively and then recharged positively in an imagewise manner using the RCP process.

Other embodiments and modifications of the present invention may occur to those skilled in the art subsequent to a review of the information presented herein; these embodiments and modifications, as well as equivalents thereof, are also included within the scope of this invention.

What is claimed is:

1. An imaging apparatus comprising an imaging member with an electrostatic latent image formed thereon, said imaging member containing a surface capable of supporting marking material;

an imaging device for generating the electrostatic latent image on said imaging member wherein the electrostatic latent image includes image areas defined by a first charge voltage and nonimage areas defined by a second charge voltage distinguishable from the first charge voltage;

a marking material supply apparatus for depositing marking material on the surface of said imaging member to form a marking material layer thereon adjacent the electrostatic latent image on said imaging member;

a charging source for selectively delivering charges to the marking material layer in an imagewise manner responsive to the electrostatic latent image on said imaging member to form a secondary latent image in the marking material layer containing image and nonimage areas corresponding to the electrostatic latent image on said imaging member; and a separator member for selectively separating portions of the marking material layer in accordance with the secondary latent image in the marking material layer to create a developed image corresponding to the electrostatic latent image formed on said imaging member, and wherein said marking material is comprised of developer containing an optional liquid, resin, colorant, and a charge acceptance additive of an aluminum complex of the formulas, or mixtures thereof

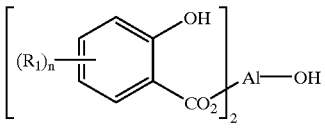

or

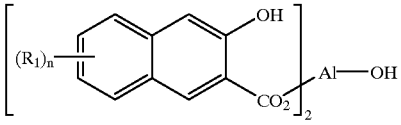

wherein $R_1$ is selected from the group consisting of hydrogen and alkyl, and n represents the number of $R_1$ groups, and wherein said charge acceptance additive captures and retains negative ions or positive ions.

2. The imaging apparatus of claim 1 wherein said imaging member includes a photosensitive imaging substrate, and wherein said marking material is comprised of said resin, said colorant, and said charge acceptance component.

3. The imaging apparatus of claim 1 wherein said imaging member includes a dielectric substrate.

4. The imaging apparatus of claim 1 wherein said imaging member includes a support surface and an electroded substructure capable of generating charged latent image areas.

5. The imaging apparatus of claim 2 further including a charging device for applying an electrostatic charge potential to said photosensitive imaging substrate.

6. The imaging apparatus of claim 5 wherein said imaging device includes an image exposure device for projecting a light image onto the photosensitive imaging substrate to generate said electrostatic latent image.

7. The imaging apparatus of claim 1 wherein said marking material supply apparatus is adapted to deposit a layer of uncharged marking particles on the surface of said imaging member, and wherein said marking particles are comprised of toner solids of said resin, said colorant, and said charge acceptance additive.

8. The imaging apparatus of claim 1 wherein said marking material supply apparatus is adapted to deposit a layer of electrically charged marking particles on the surface of said imaging member.

9. The imaging apparatus of claim 1 wherein said marking material supply apparatus is adapted to deposit a marking material layer having a thickness of from about 2 to about 15 microns on the surface of said imaging member.

10. The imaging apparatus of claim 9 wherein said marking material supply apparatus deposits a marking material layer on the surface of said imaging member, and which layer possesses a thickness in a range of from about 3 to about 8 microns.

11. The imaging apparatus of claim 1 wherein said marking material supply apparatus is adapted to accommodate said liquid developer material containing marking particles immersed in said liquid carrier medium, and wherein said marking particles contain said resin, said colorant, and said charge acceptance additive, and further wherein said charge acceptance additive functions to increase the Q/M of both a positively charged and a negatively charged developer, and wherein Q=fCV wherein C is the capacitance of the toner layer, V is the measured surface voltage, and f is a proportionality constant which is dependent upon the distribution of captured charge in the toner layer, and wherein M is the total mass of the toner solids.

12. The imaging apparatus of claim 11 wherein said marking material supply apparatus is adapted to deposit a marking material layer having a solids percentage by weight of at least about 10 percent.

13. The imaging apparatus of claim 11 wherein said marking material supply apparatus is adapted to deposit a marking material layer having a solids percentage by weight in a range of from about 15 percent to about 35 percent, and wherein said solids contain resin, colorant, and charge acceptance additive.

14. The imaging apparatus of claim 1 wherein said marking material supply apparatus includes a housing adapted to accommodate a supply of marking particles therein; and a rotatably mounted applicator roll member for transporting marking particles from said housing to the surface of said imaging member, and further wherein said charge acceptance additive functions to increase the Q/M of both a positively charged and a negatively charged developer, and wherein Q=fCV wherein C is the capacitance of the toner layer, V is the measured surface voltage, and f is a proportionality constant which is dependent upon the distribution of captured charge in the toner layer, and wherein M is the total mass of the toner solids.

15. The imaging apparatus of claim 14 wherein said marking material supply apparatus further includes an electrical biasing source coupled to said applicator roll for applying an electrical bias thereto to generate electrical fields between said applicator roll and said imaging member thereby assisting in forming the marking material layer on the surface of said imaging member.

16. The imaging apparatus of claim 1 wherein said marking material supply apparatus includes a fountain-type applicator assembly for transporting a flow of marking particles into contact with the surface of said imaging member; wherein said marking material supply apparatus further includes a metering roll for applying a shear force to the marking material layer on the surface of said imaging member to primarily control the thickness thereof.

17. The imaging apparatus of claim 1 wherein said charge source is adapted to introduce free mobile ions in the vicinity of the imaging member with the electrostatic latent image and the marking material layer supported thereon, for creating an imagewise ion stream directed toward the marking material layer responsive to the electrostatic latent image on the imaging member; and optionally wherein said charging source includes a DC biasing source coupled thereto for providing a biasing voltage to said charging source to generate ions with a single charge polarity in the vicinity of the imaging member with the electrostatic latent image and the marking material layer supported thereon, and wherein said marking material is comprised of solids of said resin, said colorant, and said charge acceptance additive.

18. The imaging apparatus of claim 17 wherein said charging source includes an AC biasing source coupled thereto for providing a biasing voltage to said charging source to generate ions having first and second charge polarities in the vicinity of the imaging member with the electrostatic latent image and the marking material layer supported thereon; and wherein said charging source further includes an optional DC biasing source coupled thereto for providing a DC offset to the biasing voltage.

19. The imaging apparatus of claim 1 wherein said charging source includes an electrical biasing source coupled to an electrode member for providing a biasing voltage intermediate the first and second charge voltages associated with the electrostatic latent image generated on the imaging member.

20. The imaging apparatus of claim 1 wherein said charging source includes an electrical biasing source coupled to an electrode member for providing a biasing voltage greater than the first and second charge voltages associated with the electrostatic latent image generated on the imaging member, and further wherein said charge acceptance additive functions to increase the Q/M of a positively charged or a negatively charged liquid developer, and wherein Q=fCV wherein C is the capacitance of the toner layer, V is the measured surface voltage, and f is a proportionality constant which is dependent upon the distribution of captured charge in the toner layer, and wherein M is the total mass of the toner solids.

21. The imaging apparatus of claim 1 wherein said charging source includes a plurality of independent ion generating devices.

22. The imaging apparatus of claim 21 wherein said plurality of independent corona generating devices includes a first corona generating device for providing ions of a first charge polarity; and a second corona generating device for providing ions of a second charge polarity.

23. The imaging apparatus of claim 1 wherein said separator member is adapted to attract marking material layer image areas associated with the secondary latent image away from the imaging member to maintain marking material layer nonimage areas or marking material layer image areas associated with the secondary latent image on the surface of the imaging member.

24. The imaging apparatus of claim 1 wherein said separator member includes a peripheral surface for contacting the marking material layer to selectively attract portions thereof away from the imaging member; or wherein said separator member includes an electrical biasing source coupled to said peripheral surface for electrically attracting selectively charged portions of the marking material layer.

25. The imaging apparatus of claim 1 further including a transfer system for transferring the developed image to a copy substrate to thereby generate an output copy thereof; and wherein said transfer system further includes an optional component for substantially simultaneously fixing the image to the copy substrate, and further wherein said charge acceptance additive functions to increase the Q/M of a positively charged or negatively charged liquid developer, and wherein Q=fCV wherein C is the capacitance of the toner layer, V is the measured surface voltage, and f is a proportionality constant which is dependent upon the distribution of captured charge in the toner layer, and wherein M is the total mass of the toner solids.

26. The imaging apparatus of claim 25 further including a fusing system for fusing the transferred image to the copy substrate, and further including a cleaning apparatus for removing marking material layer nonimage areas associated with the secondary latent image from the surface of said imaging member.

27. An imaging process comprising generating an electrostatic latent image on an imaging member with a surface capable of supporting toner particles, wherein the electrostatic latent image includes image areas encompassed by a first charge voltage and nonimage areas encompassed by a second charge voltage distinguishable from the first charge voltage;

depositing toner particles on the surface of said imaging member to form a toner layer thereon adjacent the image and nonimage areas of the electrostatic latent image wherein said toner particles are generated from a liquid developer;

selectively delivering charges to the toner layer in an imagewise manner responsive to the electrostatic latent image on said imaging member for forming a secondary latent image in the toner layer with image and nonimage areas corresponding to the electrostatic latent image on said imaging member; and selectively separating portions of the toner layer from the imaging member in accordance with the secondary latent image in the toner layer for creating a developed image corresponding to the electrostatic latent image formed on the imaging member, and wherein said toner particles are comprised of a resin, colorant, and a charge acceptance component comprised of an aluminum complex of the formulas, or mixtures thereof

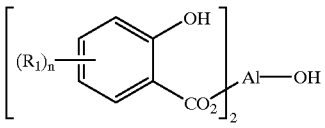

or

-continued

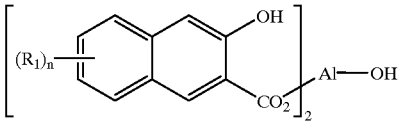

wherein $R_1$ is selected from the group consisting of hydrogen and alkyl, and n represents a number, wherein said charge acceptance additive captures and retains negative ions or positive ions, and further wherein said charge acceptance additive functions to increase the Q/M of said developer, and wherein Q=fCV wherein C is the capacitance of the toner layer, V is the measured surface voltage, and f is a proportionality constant which is dependent upon the distribution of captured charge in the toner layer, and wherein M is the total mass of the toner solids.

28. The imaging process of claim 27 wherein said electrostatic latent image generating includes charging a photosensitive imaging substrate; and selectively dissipating the charge on the photosensitive imaging substrate in accordance with the image and nonimage areas.

29. The imaging process of claim 27 wherein said electrostatic latent image generating includes selectively depositing electrical charge on a dielectric imaging member in accordance with the image and nonimage areas; and wherein said toner layer depositing includes optionally depositing a layer of uncharged or charged toner particles on the surface of the imaging member.

30. The imaging process of claim 27 wherein said toner layer depositing includes forming a toner layer having a thickness of from about 2 to about 15 microns on the surface of said imaging member.

31. The imaging process of claim 27 wherein said toner layer depositing includes depositing liquid developing material containing toner particles immersed in a liquid carrier medium.

32. The imaging process of claim 27 wherein said toner layer depositing is adapted to deposit a toner layer having a toner solids percentage by weight of at least about 10 percent, and wherein said toner solids contain said resin, said colorant, and said charge acceptance additive.

33. The imaging process of claim 32 wherein said toner layer depositing is adapted to deposit a toner layer having a toner solids percentage by weight in a range of from about 15 percent to about 35 percent.

34. The imaging process of claim 29 wherein selectively delivering charges to the toner layer is adapted to introduce free mobile ions in the vicinity of the imaging member with the electrostatic latent image and the toner layer supported thereon, for creating an imagewise ion stream directed toward the toner layer responsive to the electrostatic latent image on the imaging member.

35. The imaging process of claim 29 wherein said selectively delivering charges to the toner layer is adapted to generate ions having a single charge polarity in the vicinity of the imaging member having the electrostatic latent image and the toner layer supported thereon.

36. The imaging process of claim 29 wherein said selectively delivering charges to the toner layer is adapted to generate ions having first and second charge polarities in the vicinity of the imaging member with the electrostatic latent image and the toner layer supported thereon.

37. An image development apparatus comprising means for depositing a layer of marking particles on an imaging member;

means for creating an electrical discharge in a vicinity of the layer of marking particles on the imaging member to selectively charge the layer of marking particles in response to the electrostatic latent image on the imaging member to thereby create a second electrostatic latent image in the layer of marking particles; and means for selectively separating portions of the layer of marking particles in accordance with the second latent image for creating a developed image corresponding to the electrostatic latent image formed on the imaging member, and wherein the marking material is comprised of a liquid developer containing a liquid vehicle, thermoplastic resin, colorant, and a charge acceptance agent comprised of an aluminum complex represented by the following formulas, or mixtures thereof

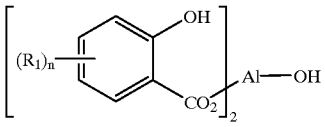

or

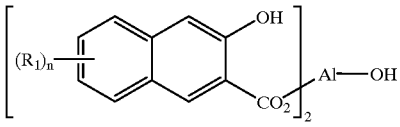

wherein $R_1$ is selected from the group consisting of hydrogen and alkyl, and n represents a number, and wherein said charge acceptance additive captures and retains negative ions or positive ions, and further wherein said charge acceptance additive functions to increase the Q/M of said liquid developer, and wherein Q=fCV wherein C is the capacitance of the toner layer, V is the measured surface voltage, and f is a proportionality constant which is dependent upon the distribution of captured charge in the toner layer, and wherein M is the total mass of the toner solids.

38. An apparatus in accordance with claim 1 wherein said developer contains said liquid with a viscosity of from about 0.5 to about 500 centipoise and resistivity equal to or greater than about $5\times10^9$, and said resin particles optionally possess a volume average particle diameter of from about 0.1 to about 30 microns.

39. An apparatus in accordance with claim 1 wherein the resin is a copolymer of ethylene and methacrylic acid.

40. An apparatus in accordance with claim 1 wherein the colorant is present in an amount of from about zero (0) to about 60 percent by weight based on the total weight of developer solids of resin, colorant, and charge acceptance additive.

41. An apparatus in accordance with claim 1 wherein the colorant is carbon black, cyan, magenta, yellow, red, green, blue, orange, violet, brown or mixtures thereof.

42. An apparatus in accordance with claim 1 wherein the charge acceptance component is present in an amount of from about 0.05 to about 10 weight percent based on the weight of the developer solids of resin, colorant, and charge acceptance additive.

43. An apparatus in accordance with claim 1 wherein the developer contains a liquid of an aliphatic hydrocarbon.

44. An apparatus in accordance with claim 43 wherein the aliphatic hydrocarbon is a mixture of branched hydrocarbons of from about 8 to about 16 carbon atoms, or a mixture of normal hydrocarbons of from about 8 to about 16 carbon atoms.

45. An apparatus in accordance with claim 1 wherein the resin is an alkylene polymer, a styrene polymer, an acrylate polymer, a polyester, or mixtures thereof.

46. An apparatus in accordance with claim 1 wherein the colorant is present in an amount of from about 3 to about 55 weight percent.

47. An apparatus in accordance with claim 1 wherein said charge acceptance additive is aluminum di-tertiary-butyl salicylate; hydroxy bis[3,5-tertiary butyl salicylic] aluminate; hydroxy bis[3,5-tertiary butyl salicylic] aluminate mono-, di-, tri- or tetrahydrates; hydroxy bis[salicylic] aluminate; hydroxy bis[monoalkyl salicylic] aluminate; hydroxy bis[dialkyl salicylic] aluminate; hydroxy bis [trialkyl salicylic] aluminate; hydroxy bis[tetraalkyl salicylic] aluminate; hydroxy bis[hydroxy naphthoic acid] aluminate; hydroxy bis[monoalkylated hydroxy naphthoic acid] aluminate; bis[dialkylated hydroxy naphthoic acid] aluminate; bis[trialkylated hydroxy naphthoic acid] aluminate; or bis[tetraalkylated hydroxy naphthoic acid] aluminate.

48. An apparatus in accordance with claim 1 wherein said charge acceptance component is hydroxy bis(3,5-di-tertiary butyl salicylic) aluminate.

49. An apparatus in accordance with claim 1 wherein said $R_1$ is hydrogen.

50. An apparatus in accordance with claim 1 wherein said $R_1$ is alkyl.

51. An apparatus in accordance with claim 1 wherein the charge acceptance component is present in an amount of from about 0.05 to about 10 weight percent based on the weight of the developer solids of resin, colorant, and charge acceptance component.

52. An apparatus in accordance with claim 1 wherein said charge acceptance additive is of the formula

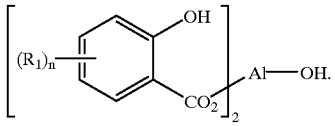

53. An apparatus in accordance with claim 1 wherein said charge acceptance component is of the formula

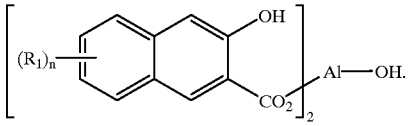

54. A process in accordance with claim 27 wherein said charge acceptance component is of the formula

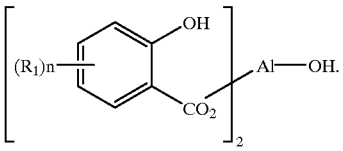

55. A process in accordance with claim 27 wherein said charge acceptance additive is of the formula

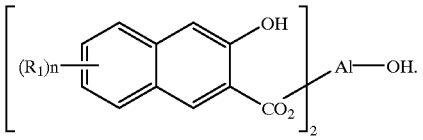

56. A process in accordance with claim 27 wherein n is a number of from 1 to about 4.

57. A process in accordance with claim 27 wherein n is a number of from 1 to about 3.

58. An imaging apparatus consisting essentially of an imaging member with an electrostatic latent image formed thereon, said imaging member containing a surface capable of supporting marking material;

an imaging device for generating the electrostatic latent image on said imaging member wherein the electrostatic latent image includes image areas defined by a first charge voltage and nonimage areas defined by a second charge voltage distinguishable from the first charge voltage;

a marking material supply apparatus for depositing marking material on the surface of said imaging member to form a marking material layer thereon adjacent the electrostatic latent image on said imaging member;

a charging source for selectively delivering charges to the marking material layer in an imagewise manner responsive to the electrostatic latent image on said imaging member to form a secondary latent image in the marking material layer containing image and nonimage areas corresponding to the electrostatic latent image on said imaging member; and a separator member for selectively separating portions of the marking material layer in accordance with the secondary latent image in the marking material layer to create a developed image corresponding to the electrostatic latent image formed on said imaging member, and wherein said marking material is comprised of developer containing a liquid, resin, colorant, and a charge acceptance additive of an aluminum complex of the formulas, or mixtures thereof

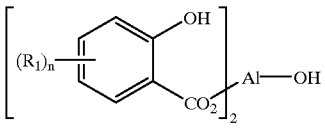

or

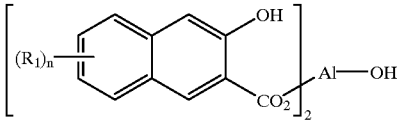

wherein $R_1$ is selected from the group consisting of hydrogen and alkyl, and n represents the number of $R_1$ groups, and wherein said charge acceptance additive captures and retains charged ions generated from a corona charging source, and further wherein said charge acceptance additive functions to increase the Q/M of said developer, and wherein Q=fCV wherein C is the capacitance of the toner layer, V is the measured surface voltage, and f is a proportionality constant which is dependent upon the distribution of captured charge in the toner layer, and wherein M is the total mass of the toner solids.

59. An apparatus in accordance with claim 58 wherein said charge acceptance additive accepts positive ions.

60. An apparatus in accordance with claim 58 wherein said charge acceptance additive accepts negative ions.

61. An apparatus in accordance with claim 58 wherein said developer is free of a charge director.

62. An imaging process consisting essentially of generating an electrostatic latent image on an imaging member with a surface capable of supporting toner particles, wherein the electrostatic latent image includes image areas encompassed by a first charge voltage and nonimage areas encompassed by a second charge voltage distinguishable from the first charge voltage;

depositing toner particles on the surface of said imaging member to form a toner layer thereon adjacent the image and nonimage areas of the electrostatic latent image;

selectively delivering charges to the toner layer in an imagewise manner responsive to the electrostatic latent image on said imaging member for forming a secondary latent image in the toner layer with image and nonimage areas corresponding to the electrostatic latent image on said imaging member; and selectively separating portions of the toner layer from the imaging member in accordance with the secondary latent image in the toner layer for creating a developed image corresponding to the electrostatic latent image formed on the imaging member, and wherein said toner particles are comprised of a developer comprised of a resin, colorant, and a charge acceptance component comprised of an aluminum complex of the formulas, or mixtures thereof

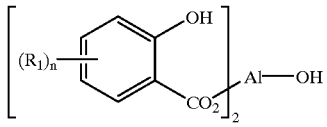

or

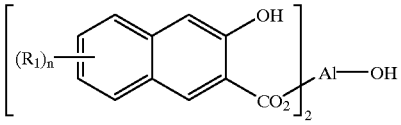

wherein $R_1$ is selected from the group consisting of hydrogen and alkyl, and n represents a number, and wherein said charge acceptance additive captures and retains ions, and further wherein said charge acceptance additive functions to increase the Q/M of both said developer, and wherein Q=fCV, wherein C is the capacitance of the toner layer, V is the measured surface voltage, and f is a proportionality constant which is dependent upon the distribution of captured charge in the toner layer, and wherein M is the total mass of the toner solids, and wherein said toner particles are free of a charge director.

* * * * *